US012692851B2

(12) United States Patent
Mochidzuki

(10) Patent No.: US 12,692,851 B2
(45) Date of Patent: Jul. 28, 2026

(54) CRYOPUMP, CRYOPUMP SYSTEM, AND CRYOPUMP REGENERATION METHOD

(71) Applicant: SUMITOMO HEAVY INDUSTRIES, LTD., Tokyo (JP)

(72) Inventor: Kenji Mochidzuki, Tokyo (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 1179 days.

(21) Appl. No.: 17/078,811

(22) Filed: Oct. 23, 2020

(65) Prior Publication Data

US 2021/0054834 A1 Feb. 25, 2021

Related U.S. Application Data

(63) Continuation of application No. PCT/JP2019/016360, filed on Apr. 16, 2019.

(30) Foreign Application Priority Data

Apr. 25, 2018 (JP) ..... 2018-083687
Dec. 21, 2018 (JP) ..... 2018-239174

(51) Int. Cl.

| | |
|---|---|
| ***F04B 37/08*** | (2006.01) |
| ***F04B 37/02*** | (2006.01) |
| *F04B 37/14* | (2006.01) |
| *F04B 49/06* | (2006.01) |

(52) U.S. Cl.

CPC ..... *F04B 37/085* (2013.01); *F04B 37/02* (2013.01); *F04B 37/14* (2013.01); *F04B 49/06* (2013.01); *F04B 2201/0801* (2013.01); *F04B 2205/01* (2013.01)

(58) Field of Classification Search

CPC ..... F04B 37/08; F04B 37/085
USPC ..... 62/55.5
See application file for complete search history.

(56) References Cited

U.S. PATENT DOCUMENTS

| | | | | |
|---|---|---|---|---|
| 5,375,424 | A * | 12/1994 | Bartlett | F04B 37/08 62/55.5 |
| 5,819,545 | A | 10/1998 | Eacobacci | |
| 6,022,195 | A | 2/2000 | Gaudet et al. | |
| 9,926,920 | B2 | 3/2018 | Oikawa | |
| 2007/0125112 | A1* | 6/2007 | Tsuyuki | F04B 37/08 62/272 |
| 2012/0285182 | A1* | 11/2012 | Ando | F04B 37/08 62/55.5 |
| 2014/0260338 | A1* | 9/2014 | Kimura | F04B 37/08 62/55.5 |

(Continued)

FOREIGN PATENT DOCUMENTS

| | | | |
|---|---|---|---|
| JP | S61-205382 | A | 9/1986 |
| JP | H05-263760 | A | 10/1993 |

(Continued)

*Primary Examiner* — John F Pettitt, III
(74) *Attorney, Agent, or Firm* — Michael Best & Friedrich LLP

(57) ABSTRACT

A cryopump includes a cryopanel, and an adsorption area provided on the cryopanel and capable of adsorbing a non-condensable gas, in which the adsorption area includes a non-combustible adsorbent containing silica gel as a main component thereof. The adsorption area includes a non-combustible adsorbent containing silica gel as a main component thereof.

14 Claims, 9 Drawing Sheets

(56) References Cited

U.S. PATENT DOCUMENTS

| | | | | |
|---|---|---|---|---|
| 2015/0267693 | A1* | 9/2015 | Oikawa | F04B 37/085<br>62/55.5 |
| 2016/0245270 | A1* | 8/2016 | Yatsu | F04B 49/065 |
| 2017/0007982 | A1* | 1/2017 | Holbrook | F17C 11/007 |

FOREIGN PATENT DOCUMENTS

| | | | |
|---|---|---|---|
| JP | H06-154505 | A | 6/1994 |
| JP | 2000-227070 | A | 8/2000 |
| JP | 2001-515176 | A | 9/2001 |
| JP | 2012-237293 | A | 12/2012 |
| JP | 2016-153617 | A | 8/2016 |
| JP | 2016-191374 | A | 11/2016 |

* cited by examiner

| | AVERAGE PORE SIZE[nm] | PACKING DENSITY[g/mL] | PORE VOLUME [mL/g] | SPECIFIC SURFACE AREA [$m^2$/g] |
|---|---|---|---|---|
| SILICA GEL A TYPE | 2.5 | 0.73 | 0.40 | 650 |
| SILICA GEL N TYPE | 2.1 | 0.80 | 0.32 | 600 |
| SILICA GEL RD TYPE | 2.2 | 0.73 | 0.40 | 720 |
| SILICA GEL B TYPE | 6.7 | 0.50 | 0.75 | 450 |
| SILICA GEL ID TYPE | 17.9 | 0.33 | 1.30 | 290 |

CRYOPUMP, CRYOPUMP SYSTEM, AND CRYOPUMP REGENERATION METHOD

RELATED APPLICATIONS

The contents of Japanese Patent Application Nos. 2018-083687 and 2018-239174, and of International Patent Application No. PCT/JP2019/016360, on the basis of each of which priority benefits are claimed in an accompanying application data sheet, are in their entirety incorporated herein by reference.

BACKGROUND

Technical Field

Certain embodiments of the present invention relate to a cryopump, a cryopump system, and a cryopump regeneration method.

Description of Related Art

A cryopump is a vacuum pump which captures gas molecules on a cryopanel cooled to a cryogenic temperature by condensation or adsorption to exhaust the gas molecules. The cryopump is generally used to realize a clean vacuum environment which is required fora semiconductor circuit manufacturing process or the like. Since the cryopump is a so-called gas accumulation type vacuum pump, regeneration to periodically discharge the captured gas to the outside is required.

SUMMARY

According to an embodiment of the present invention, there is provided a cryopump including: a cryopanel; and an adsorption area provided on the cryopanel and capable of adsorbing a non-condensable gas, in which the adsorption area includes a non-combustible adsorbent containing silica gel as a main component thereof.

According to another embodiment of the present invention, there is provided a cryopump system including: the cryopump described above; at least one other cryopump; a rough pump common to the cryopump and the at least one other cryopump; and a regeneration controller that receives a regeneration start command for each cryopump and starts regeneration of the cryopump. The regeneration controller delays the regeneration start of the at least one other cryopump until after the regeneration of the cryopump is completed in a case where the regeneration controller receives the regeneration start command for the at least one other cryopump, during the regeneration of the cryopump.

According to still another embodiment of the present invention, there is provided a cryopump including: a cryopump housing; an adsorption cryopanel disposed in the cryopump housing and provided with a hydrophilic adsorbent; a pressure sensor that generates a pressure measurement signal indicating an internal pressure of the cryopump housing; a rough valve mounted to the cryopump housing and connecting the cryopump housing to a rough pump; a first pressure rise rate monitor that receives the pressure measurement signal and compares a pressure rise rate with a first threshold value when the rough valve is opened, based on the pressure measurement signal; a second pressure rise rate monitor that receives the pressure measurement signal and compares the pressure rise rate with a second threshold value smaller than the first threshold value when the rough valve is opened, based on the pressure measurement signal, on a condition that the first pressure rise rate monitor determines that the pressure rise rate is larger than the first threshold value; and a rough valve driver that closes the rough valve, on a condition that the second pressure rise rate monitor determines that the pressure rise rate is smaller than the second threshold value, as one condition.

According to still yet another embodiment of the present invention, there is provided a cryopump regeneration method. The cryopump has a hydrophilic adsorbent. The regeneration method includes: comparing a pressure rise rate with a first threshold value when the cryopump is being evacuated; comparing the pressure rise rate with a second threshold value smaller than the first threshold value when the cryopump is being evacuated on a condition that it is determined that the pressure rise rate is larger than the first threshold value; and stopping the evacuation of the cryopump on a condition that it is determined that the pressure rise rate is smaller than the second threshold value, as one condition.

According to still yet another embodiment of the present invention, there is provided a cryopump regeneration method. The cryopump has a hydrophilic adsorbent. The regeneration method includes: supplying a purge gas to the cryopump; stopping the supply of the purge gas to the cryopump before a cryopanel temperature exceeds a triple point temperature of water; starting evacuation of the cryopump simultaneously with the stop of the supply of the purge gas or after the stop of the supply; vaporizing ice condensed in the cryopump by sublimation; and stopping the evacuation of the cryopump, based on at least one of a pressure in the cryopump and a pressure rise rate.

DETAILED DESCRIPTION

Figure 1:
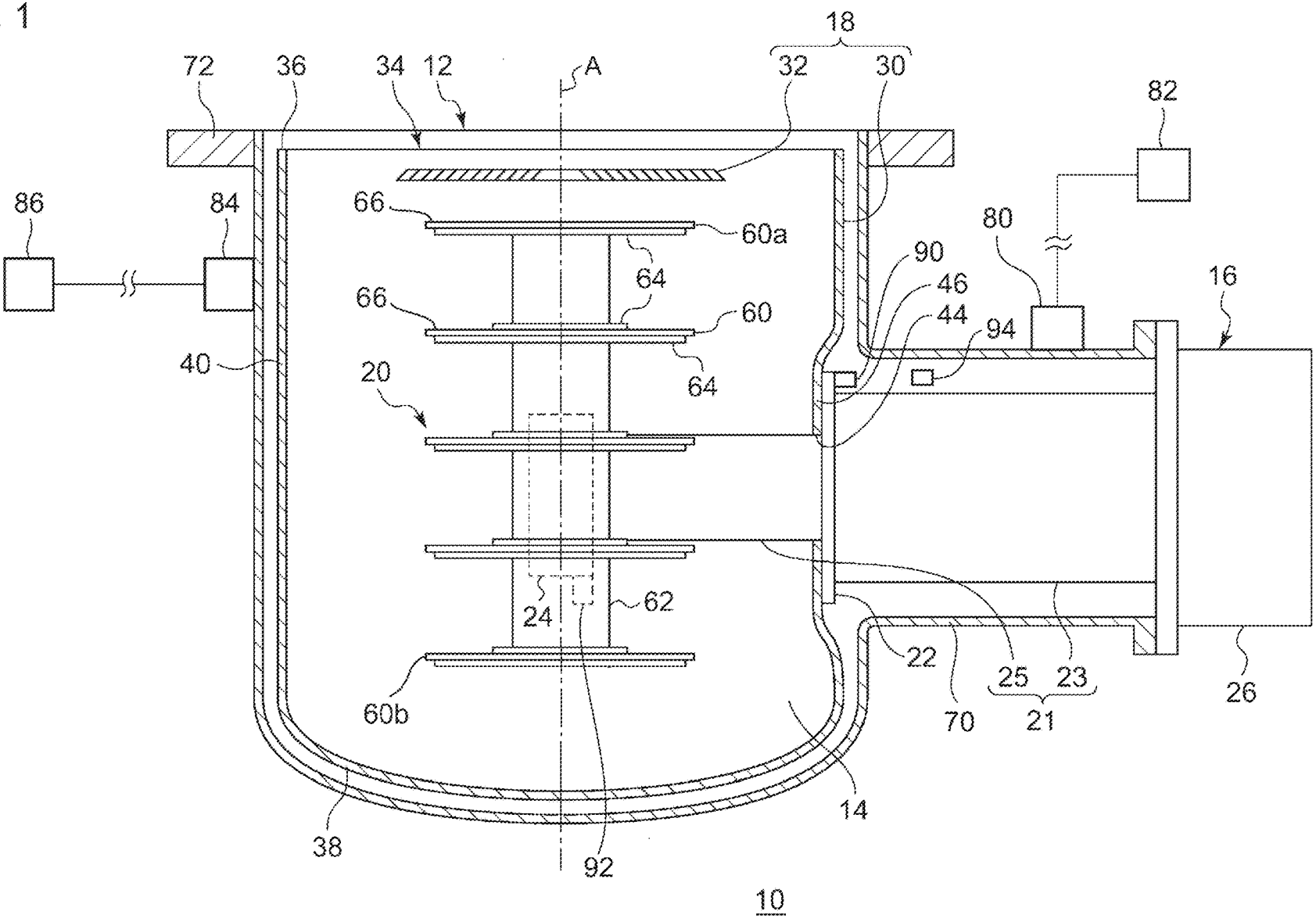
FIG. 1 is a diagram schematically showing a cryopump according to an embodiment.

It is desirable to provide a novel cryopump for exhausting a non-condensable gas.

Any combination of the constituent elements described above, or replacement of constituent elements or expressions of the present invention with each other between methods, apparatuses, systems, or the like is also valid as an aspect of the present invention.

According to the present invention, it is possible to provide a novel cryopump that exhausts a non-condensable gas.

Cryopumps typically have adsorbents on cryopanels in order to adsorb non-condensable gases such as hydrogen, which do not condense on the cryopanels. The adsorbent is typically activated carbon. Further, the type of gas which is exhausted to the cryopump varies according to the use of the cryopump. However, in a certain use, oxygen is contained. In this case, oxygen may exist around the activated carbon at the time of the use of the cryopump, such as during regeneration. Since activated carbon is a combustible material, it cannot be denied that there is a risk of accidental ignition due to some factors in the presence of oxygen.

One of the exemplary purposes of an aspect of the present invention is to improve the safety of the cryopump.

The cryopump has an adsorbent on the cryopanel in order to adsorb a non-condensable gas such as hydrogen, which does not condense on the cryopanel. A commonly used adsorbent is activated carbon, which is hydrophobic.

A case where water vapor is contained in a gas which is exhausted to the cryopump is not uncommon. The water vapor is captured by the cryopanel as a solid (ice). In a typical regeneration method, before ice vaporizes again and is discharged to the outside, the ice first melts into water. Liquid water may flow to and wet the adsorbent. Ina case where the adsorbent includes a hydrophilic material, water molecules strongly combine with the adsorbent. Then, dehydration of the adsorbent requires a considerably long time, which is not desirable. Such problems recognized by the inventor of the present invention should not be understood as a general recognition by those skilled in the art.

One of the exemplary purposes of an aspect of the present invention is to shorten a regeneration time for a cryopump having a hydrophilic adsorbent.

Hereinafter, modes for carrying out the present invention will be described in detail with reference to the drawings. In the description, identical elements will be denoted by the same reference symbols and overlapping description will be omitted appropriately. Further, the configuration which is described below is exemplification and does not limit the scope of the present invention. Further, in the drawings which are referred to in the following description, the size or thickness of each constituent member is for convenience of description, and does not necessarily indicate actual dimension or ratio.

FIG. 1 schematically shows a cryopump 10 according to an embodiment. The cryopump 10 is mounted to a vacuum chamber of, for example, an ion implanter, a sputtering apparatus, a vapor deposition apparatus, or other vacuum process equipment and is used to increase the degree of vacuum in the interior of the vacuum chamber to a level which is required for a desired vacuum process. The cryopump 10 has an intake port 12 for receiving a gas to be exhausted, from the vacuum chamber. The gas enters an internal space 14 of the cryopump 10 through the intake port 12.

In the following, there is a case where the terms "axial direction" and "radial direction" are used in order to express the positional relationship between constituent elements of the cryopump 10 in an easily understandable manner. The axial direction represents a direction passing through the intake port 12 (in FIG. 1, a direction along a central axis A), and the radial direction represents a direction along the intake port 12 (a direction perpendicular to the central axis A). For convenience, with respect to the axial direction, there is a case where the side relatively close to the intake port 12 is referred to as an "upper side" and the side relatively distant from the intake port 12 is referred to as a "lower side". That is, there is a case where the side relatively distance from the bottom of the cryopump 10 is referred to as an "upper side" and the side relatively close to the bottom of the cryopump 10 is referred to as a "lower side". With respect to the radial direction, there is a case where the side close to the center (in FIG. 1, the central axis A) of the intake port 12 is referred to as an "inner side" and the side close to the peripheral edge of the intake port 12 is referred to as an "outer side". Such expressions are not related to the disposition when the cryopump 10 is mounted to the vacuum chamber. For example, the cryopump 10 may be mounted to the vacuum chamber with the intake port 12 facing downward in the vertical direction.

Further, there is a case where a direction surrounding the axial direction is referred to as a "circumferential direction". The circumferential direction is a second direction along the intake port 12 and is a tangential direction orthogonal to the radial direction.

The cryopump 10 includes a cryocooler 16, a first cryopanel unit 18, a second cryopanel unit 20, and a cryopump housing 70. The first cryopanel unit 18 may be referred to as a high-temperature cryopanel part or a 100 K part. The second cryopanel unit 20 may be referred to as a low-temperature cryopanel part or a 10 K part.

The cryocooler 16 is a cryocooler such as a Gifford McMahon type cryocooler (a so-called GM cryocooler), for example. The cryocooler 16 is a two-stage cryocooler. Therefore, the cryocooler 16 includes a first cooling stage 22 and a second cooling stage 24. The cryocooler 16 is configured to cool the first cooling stage 22 to a first cooling temperature and cool the second cooling stage 24 to a second cooling temperature. The second cooling temperature is lower than the first cooling temperature. For example, the first cooling stage 22 is cooled to a temperature in a range of about 65 K to 120 K, preferably, in a range of 80 K to 100 K, and the second cooling stage 24 is cooled to a temperature in a range of about 10 K to 20 K. The first cooling stage 22 and the second cooling stage 24 may be referred to as a high-temperature cooling stage and a low-temperature cooling stage, respectively.

Further, the cryocooler 16 includes a cryocooler structure part 21 that structurally supports the second cooling stage 24 on the first cooling stage 22 and structurally supports the first cooling stage 22 on a room temperature part 26 of the cryocooler 16. Therefore, the cryocooler structure part 21 includes a first cylinder 23 and a second cylinder 25 that extend coaxially along the radial direction. The first cylinder 23 connects the room temperature part 26 of the cryocooler 16 to the first cooling stage 22. The second cylinder 25 connects the first cooling stage 22 to the second cooling stage 24. The room temperature part 26, the first cylinder 23, the first cooling stage 22, the second cylinder 25, and the second cooling stage 24 are linearly arranged in this order.

A first displacer and a second displacer (not shown) are reciprocally disposed in the interiors of the first cylinder 23 and the second cylinder 25, respectively. A first regenerator and a second regenerator (not shown) are respectively incorporated into the first displacer and the second displacer. Further, the room temperature part 26 has a drive mechanism (not shown) for reciprocating the first displacer and the second displacer. The drive mechanism includes a flow path switching mechanism that switches a flow path of a working gas (for example, helium) so as to periodically repeat the supply and discharge of the working gas to and from the interior of the cryocooler 16.

The cryocooler 16 is connected to a compressor (not shown) for the working gas. The cryocooler 16 cools the first cooling stage 22 and the second cooling stage 24 by expanding the working gas pressurized by the compressor in the interior thereof. The expanded working gas is recovered to the compressor and pressurized again. The cryocooler 16 generates cold by repeating a heat cycle including the supply and discharge of the working gas and the reciprocation of the first displacer and the second displacer in synchronization with the supply and discharge of the working gas.

The cryopump 10 which is shown in the drawing is a so-called horizontal cryopump. The horizontal cryopump is generally a cryopump in which the cryocooler 16 is disposed so as to intersect (usually, be orthogonal to) the central axis A of the cryopump 10.

The first cryopanel unit 18 includes a radiation shield 30 and an inlet cryopanel 32 and surrounds the second cryopanel unit 20. The first cryopanel unit 18 provides a cryogenic surface for protecting the second cryopanel unit 20 from radiant heat outside the cryopump or from the cryopump housing 70. The first cryopanel unit 18 is thermally coupled to the first cooling stage 22. Accordingly, the first cryopanel unit 18 is cooled to the first cooling temperature. The first cryopanel unit 18 has a gap between itself and the second cryopanel unit 20, and the first cryopanel unit 18 is not in contact with the second cryopanel unit 20. The first cryopanel unit 18 is also not in contact with the cryopump housing 70.

The first cryopanel unit 18 can also be referred to as a condensation cryopanel. The second cryopanel unit 20 can also be referred to as an adsorption cryopanel.

The radiation shield 30 is provided in order to protect the second cryopanel unit 20 from the radiant heat of the cryopump housing 70. The radiation shield 30 is located between the cryopump housing 70 and the second cryopanel unit 20 and surrounds the second cryopanel unit 20. The radiation shield 30 has a shield main opening 34 for receiving gas from the outside of the cryopump 10 into the internal space 14. The shield main opening 34 is located at the intake port 12.

The radiation shield 30 is provided with a shield front end 36 defining the shield main opening 34, a shield bottom portion 38 which is located on the side opposite to the shield main opening 34, and a shield side portion 40 connecting the shield front end 36 to the shield bottom portion 38. The shield side portion 40 extends in the axial direction from the shield front end 36 to the side opposite to the shield main opening 34, and extends so as to surround the second cooling stage 24 in the circumferential direction.

The shield side portion 40 has a shield side portion opening 44 into which the cryocooler structure part 21 is inserted. The second cooling stage 24 and the second cylinder 25 are inserted into the radiation shield 30 from outside the radiation shield 30 through the shield side portion opening 44. The shield side portion opening 44 is a mounting hole formed in the shield side portion 40 and is, for example, circular. The first cooling stage 22 is disposed outside the radiation shield 30.

The shield side portion 40 is provided with a mounting seat 46 for the cryocooler 16. The mounting seat 46 is a flat portion for mounting the first cooling stage 22 to the radiation shield 30, and is slightly depressed when viewed from outside the radiation shield 30. The mounting seat 46 forms the outer periphery of the shield side portion opening 44. The first cooling stage 22 is mounted to the mounting seat 46, whereby the radiation shield 30 is thermally coupled to the first cooling stage 22.

Instead of directly mounting the radiation shield 30 to the first cooling stage 22 in this manner, in an embodiment, the radiation shield 30 may be thermally coupled to the first cooling stage 22 through an additional heat transfer member.

In the illustrated embodiment, the radiation shield 30 is configured in an integral tubular shape. Instead, the radiation shield 30 may be configured to have a tubular shape as a whole by a plurality of parts. The plurality of parts may be disposed with a gap therebetween. For example, the radiation shield 30 may be divided into two parts in the axial direction.

The inlet cryopanel 32 is provided in the intake port 12 (or the shield main opening 34, the same applies hereinafter) in order to protect the second cryopanel unit 20 from the radiant heat from a heat source outside the cryopump 10 (for example, a heat source in the vacuum chamber to which the cryopump 10 is mounted). Further, gas (for example, moisture) condensing at the cooling temperature of the inlet cryopanel 32 is captured on the surface thereof.

The inlet cryopanel 32 is disposed at a place corresponding to the second cryopanel unit 20 in the intake port 12. The inlet cryopanel 32 occupies at least the central portion of the opening area of the intake port 12. The inlet cryopanel 32 has a planar structure disposed in the intake port 12. The inlet cryopanel 32 may include, for example, a louver or a chevron formed in a concentric circle shape or a lattice shape, or may include a flat plate (for example, a disk).

The inlet cryopanel 32 is mounted to the shield front end 36 through a mounting member (not shown). In this manner, the inlet cryopanel 32 is fixed to the radiation shield 30 and is thermally connected to the radiation shield 30. The inlet cryopanel 32 is adjacent to, but not in contact with, the second cryopanel unit 20.

The second cryopanel unit 20 is provided at the central portion of the internal space 14 of the cryopump 10. The second cryopanel unit 20 includes a plurality of cryopanels 60 and a panel mounting member 62. The panel mounting member 62 extends axially upward and downward from the second cooling stage 24. The second cryopanel unit 20 is mounted to the second cooling stage 24 through the panel mounting member 62. In this way, the second cryopanel unit 20 is thermally connected to the second cooling stage 24. Accordingly, the second cryopanel unit 20 is cooled to the second cooling temperature.

The plurality of cryopanels 60 are arranged on the panel mounting member 62 along the direction from the shield main opening 34 to the shield bottom portion 38 (that is, along the central axis A). The plurality of cryopanels 60 each are a flat plate (for example, a disk) that extends perpendicularly to the central axis A, and are mounted on the panel mounting member 62 in parallel with each other. The cryopanel 60 is not limited to a flat plate, and the shape thereof is not particularly limited. For example, the cryopanel 60 may have an inverted truncated cone shape or a truncated cone shape.

The plurality of cryopanels 60 may have the same shape as shown, or may have different shapes (for example, different diameters). Any cryopanel 60 of the plurality of cryopanels 60 may have the same shape as the upper cryopanel 60 adjacent thereto, or may have a larger size than that. Further, the intervals between the plurality of cryopanels 60 may be constant as shown, or may be different from each other.

In the second cryopanel unit 20, an adsorption area 64 is formed on at least a part of the surface. The adsorption area 64 is provided in order to capture a non-condensable gas (for example, hydrogen) by adsorption. The adsorption area 64 may be formed in a place that is hidden behind the cryopanel 60 adjacent to the upper side so as not to be seen from the intake port 12. For example, the adsorption area 64 is formed on the entire lower surface (back surface) of the cryopanel 60. Further, the adsorption area 64 may be formed in at least the central portion of the upper surface (front surface) of the cryopanel 60.

The adsorption area 64 may be formed by bonding granular adsorbents to the surface of the cryopanel 60. The particle size of the adsorbent may be, for example, in a range of 2 mm to 5 mm. In this way, the bonding work at the time of manufacturing becomes easier.

The adsorption area 64 includes a non-combustible adsorbent containing silica gel as a main component thereof. The non-combustible adsorbent may include at least about 50 weight percent, at least about 60 weight percent, at least about 70 weight percent, at least about 80 weight percent, or at least about 90 weight percent of silica gel. Substantially all of the non-combustible adsorbents may be silica gel. Since silica gel contains silicon dioxide as a main component thereof, it does not chemically react with oxygen.

In this manner, the adsorbent forming the adsorption area 64 is formed of a porous body made of an inorganic substance and does not contain an organic substance. Unlike a typical cryopump, the adsorption area 64 of the cryopump 10 does not contain activated carbon.

Figures 2, 3:
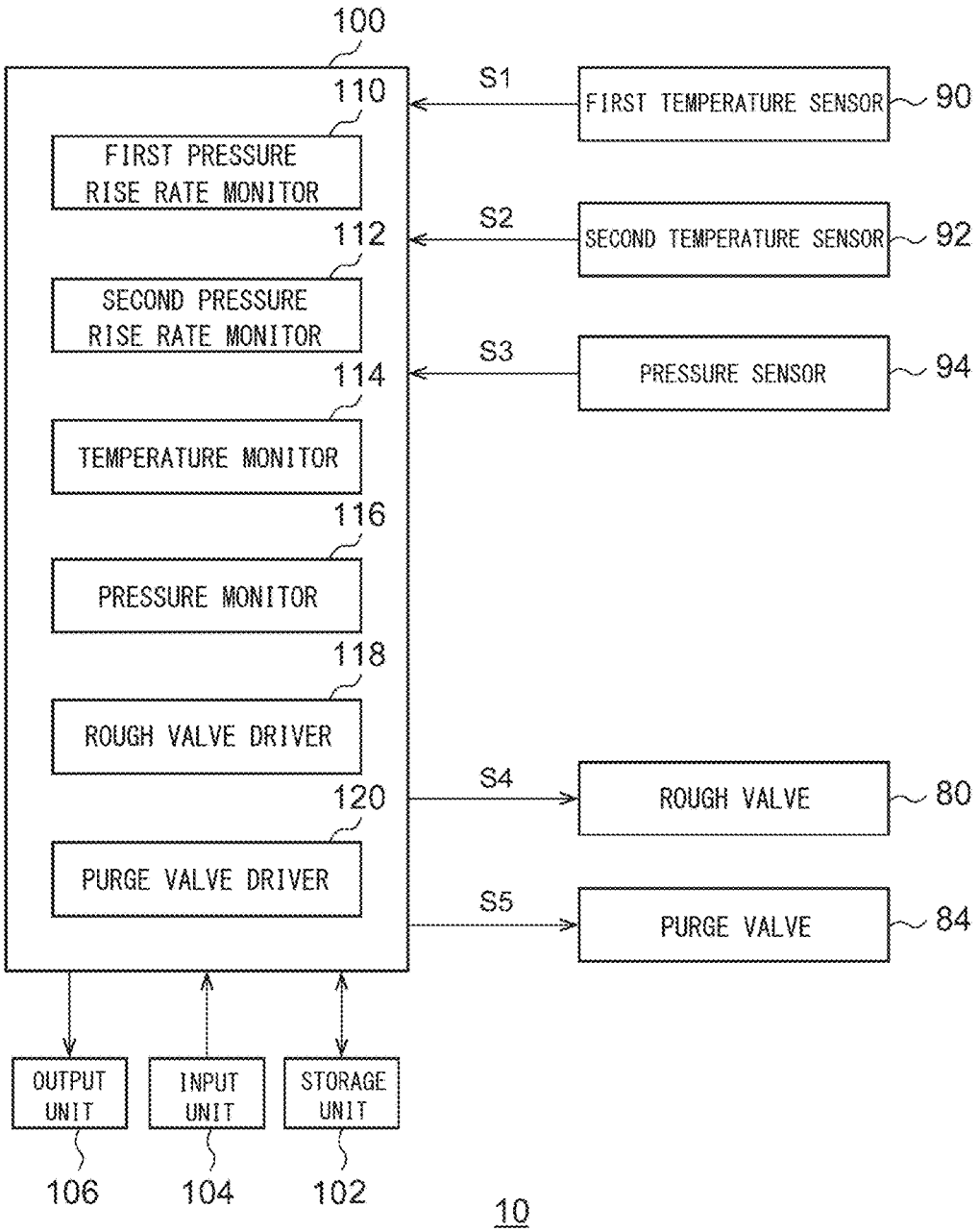
FIG. 2 is a table showing typical physical properties of silica gel that can be used as a non-combustible adsorbent that forms an adsorption area according to an embodiment.
FIG. 3 is a block diagram of a cryopump according to an embodiment.

As typical parameters related to the adsorption characteristics of the porous body, there are an average pore size, packing density, pore volume, and a specific surface area. As commonly available silica gel, there are several types such as silica gel A type, silica gel B type, silica gel N type, silica gel RD type, and silica gel ID type, for example. Therefore, these four parameters of each type of silica gel are shown in FIG. 2.

The inventor of the present invention formed the adsorption area 64 on the cryopanel 60 by bonding each type of granular silica gel to the cryopanel 60, and measured a hydrogen storage capacity under common conditions. It was found that the silica gel A type, the silica gel RD type, and the silica gel N type adsorb more hydrogen than the silica gel B type and the silica gel ID type. The measurement results of the hydrogen storage capacity per unit area of the adsorption area 64 are shown below with respect to the silica gel A type, the silica gel N type, and the silica gel RD type.

Silica gel A type: 251 ($L/m^2$)

Silica gel RD type: 195 ($L/m^2$)

Silica gel N type: 179 ($L/m^2$)

Therefore, the silica gel A type, the silica gel RD type, and the silica gel N type are expected to be suitable for practical use as an adsorbent for the non-condensable gas, which is used in the cryopump 10. The silica gel B type and the silica gel ID type may also be usable as an adsorbent for the non-condensable gas in the use in which the required storage capacity is relatively small.

It is considered that the storage capacity for the non-condensable gas by a certain adsorbent is improved as the average pore size of the adsorbent is smaller, for the following two reasons. First, this is because the smaller the diameter of the pore is, the greater the number of pores per unit area on the surface of the adsorbent can become. As a result, the surface area where the gas is adsorbed increases, and thus the gas molecules are easily adsorbed.

Further, the adsorption is caused by a physical interaction between the surface of the adsorbent and gas molecules, for example, intermolecular force. The smaller the diameter of the pore is, the closer the size of the pore is to the size of the gas molecule. Then, when gas molecules enter the pores, the inner wall surface of the pore is more likely to exist within a distance range in which interaction can occur around the gas molecules. The interaction between the gas molecules and the wall surface of the pore easily occurs, and thus the gas molecules are easily adsorbed. This is the second reason.

Based on these findings, the silica gel preferably has an average pore size of 3.0 nm or less in order to obtain good non-condensable gas adsorption characteristics. Further, since the size of hydrogen molecule is about 0.1 nm, the silica gel preferably has a larger average pore size than that, for example, an average pore size of 0.5 nm or more.

More preferably, the silica gel has an average pore size in a range of 2.0 nm to 3.0 nm. As can be seen from FIG. 2, the silica gel A type, the silica gel RD type, and the silica gel N type have average pore sizes included in this preferable range. The average pore sizes of the silica gel B type and the silica gel ID type are considerably larger than this range.

When the average pore sizes of the silica gel type A, the silica gel RD type, and the silica gel N type are compared with each other, the silica gel A type has a larger average pore size than the other two types. However, the silica gel A type has a larger hydrogen storage capacity per unit area, as described above. The reason why the silica gel A type gives good results in this way is that the silica gel A type is easy to obtain granular silica gel having a uniform shape. The uniform silica gel particles are easy to be closely arranged and bonded to the surface of the cryopanel. Therefore, the silica gel A type can be installed on the cryopanel 60 at higher density as compared with irregular-shaped granular silica gel and can increase the storage capacity.

Further, in addition to having an average pore size within the above range, the silica gel preferably has packing density in a range of 0.7 to 0.9 g/mL, pore volume in a range of 0.25 to 0.45 mL/g, and a specific surface area in a range of 550 to 750 $m^2/g$. The silica gel having such physical properties is expected to have good adsorption properties, as in the silica gel A type, the silica gel RD type, and the silica gel N type.

A condensation area 66 for capturing a condensable gas by condensation is formed on at least a part of the surface of the second cryopanel unit 20. The condensation area 66 is, for example, a section where the adsorbent is missing on the surface of the cryopanel, and the surface of a cryopanel base material, for example, a metal surface is exposed. For example, the outer peripheral portion of the upper surface of the cryopanel 60 may be a condensation area.

The cryopump housing 70 is a casing of the cryopump 10, which accommodates the first cryopanel unit 18, the second cryopanel unit 20, and the cryocooler 16, and is a vacuum container configured to maintain the vacuum tightness of the internal space 14. The cryopump housing 70 includes the first cryopanel unit 18 and the cryocooler structure part 21 in a non-contact manner. The cryopump housing 70 is mounted to the room temperature part 26 of the cryocooler 16.

The intake port 12 is defined by a front end of the cryopump housing 70. The cryopump housing 70 has an intake port flange 72 extending radially outward from a front end thereof. The intake port flange 72 is provided over the entire circumference of the cryopump housing 70. The cryopump 10 is mounted to a vacuum chamber to be evacuated by using the intake port flange 72.

A rough valve 80 and a purge valve 84 are mounted to the cryopump housing 70.

The rough valve 80 is connected to a rough pump 82. By the opening and closing of the rough valve 80, the rough pump 82 and the cryopump 10 communicate with each other or are shut off from each other. By opening the rough valve 80, the rough pump 82 and the cryopump housing 70 communicate with each other, and by closing the rough valve 80, the rough pump 82 and the cryopump housing 70 are shut off from each other. By opening the rough valve 80 and operating the rough pump 82, the interior of the cryopump 10 can be depressurized.

The rough pump 82 is a vacuum pump for evacuating the cryopump 10. The rough pump 82 is a vacuum pump for providing the cryopump 10 with a low vacuum region in an operating pressure range of the cryopump 10, in other words, a base pressure level which is an operation starting pressure of the cryopump 10. The rough pump 82 can reduce the pressure in the cryopump housing 70 from atmospheric pressure to a base pressure level. The base pressure level corresponds to a high vacuum region of the rough pump 82 and is included in an overlapping portion of the operating pressure ranges of the rough pump 82 and the cryopump 10. The base pressure level is, for example, in a range of 1 Pa or more and 50 Pa or less (for example, about 10 Pa).

The rough pump 82 is typically provided as a vacuum device separate from the cryopump 10, and configures a part of a vacuum system including a vacuum chamber to which the cryopump 10 is connected, for example. The cryopump 10 is a main pump for the vacuum chamber and the rough pump 82 is an auxiliary pump.

The purge valve 84 is connected to a purge gas supply device which includes a purge gas source 86. By the opening and closing of the purge valve 84, the purge gas source 86 and the cryopump 10 communicate with each other or is shut off from each other, and thus the supply of a purge gas to the cryopump 10 is controlled. By opening the purge valve 84, the flow of the purge gas from the purge gas source 86 to the cryopump housing 70 is permitted. By closing the purge valve 84, the flow of the purge gas from the purge gas source 86 to the cryopump housing 70 is shut off. By opening the purge valve 84 and introducing the purge gas from the purge gas source 86 into the cryopump housing 70, the pressure in the interior of the cryopump 10 can be increased. The supplied purge gas is discharged from the cryopump 10 through the rough valve 80.

The temperature of the purge gas is adjusted to, for example, room temperature. However, in an embodiment, the purge gas may be a gas heated to a temperature higher than room temperature or a gas slightly lower than room temperature. In the present specification, room temperature is a temperature selected from the range of 10° C. to 30° C. or the range of 15° C. to 25° C., and is, for example, about 20° C. The purge gas is, for example, nitrogen gas. The purge gas may be a dry gas.

The cryopump 10 includes a first temperature sensor 90 for measuring the temperature of the first cooling stage 22, and a second temperature sensor 92 for measuring the temperature of the second cooling stage 24. The first temperature sensor 90 is mounted to the first cooling stage 22. The second temperature sensor 92 is mounted to the second cooling stage 24. Therefore, the first temperature sensor 90 can measure the temperature of the first cryopanel unit 18, and the second temperature sensor 92 can measure the temperature of the second cryopanel unit 20.

Further, a pressure sensor 94 is provided inside the cryopump housing 70. The pressure sensor 94 is provided in the vicinity of the cryocooler 16 outside the first cryopanel unit 18, for example. The pressure sensor 94 can measure the internal pressure of the cryopump housing 70.

The operation of the cryopump 10 having the configuration described above will be described below. When the cryopump 10 is operated, first, the interior of the vacuum chamber is roughed to about 1 Pa with another appropriate roughing pump before the operation. Thereafter, the cryopump 10 is operated. The first cooling stage 22 and the second cooling stage 24 are respectively cooled to the first cooling temperature and the second cooling temperature by the driving of the cryocooler 16. Accordingly, the first cryopanel unit 18 and the second cryopanel unit 20 thermally coupled to these are also cooled to the first cooling temperature and the second cooling temperature, respectively.

The inlet cryopanel 32 cools the gas which comes flying from the vacuum chamber toward the cryopump 10. A gas having a sufficiently low vapor pressure (for example, $10^{-8}$ Pa or less) at the first cooling temperature condenses on the surface of the inlet cryopanel 32. This gas may be referred to as a type 1 gas. The type 1 gas is, for example, water vapor. In this way, the inlet cryopanel 32 can exhaust the type 1 gas. A part of a gas in which vapor pressure is not sufficiently low at the first cooling temperature enters the internal space 14 from the intake port 12. Alternatively, the other part of the gas is reflected by the inlet cryopanel 32 and does not enter the internal space 14.

The gas that has entered the internal space 14 is cooled by the second cryopanel unit 20. A gas having a sufficiently low vapor pressure (for example, $10^{-8}$ Pa or less) at the second cooling temperature condenses on the surface of the second cryopanel unit 20. This gas may be referred to as a type 2 gas. The type 2 gas may be, for example, argon. In this way, the second cryopanel unit 20 can exhaust the type 2 gas.

A gas in which vapor pressure is not sufficiently low at the second cooling temperature is adsorbed by the adsorbent of the second cryopanel unit 20. This gas may be referred to as a type 3 gas. The type 3 gas is also referred to as a non-condensable gas and is, for example, hydrogen. In this way, the second cryopanel unit 20 can exhaust the type 3 gas. Therefore, the cryopump 10 can exhaust various gases by condensation or adsorption and can make the degree of vacuum of the vacuum chamber reach a desired level.

The exhaust operation is continued, whereby gas continues to accumulate in the cryopump 10. The regeneration of the cryopump 10 is performed in order to discharge the accumulated gas to the outside. During the regeneration, the cryopump 10 is heated and the gas is released from the cryopanel 60.

A typical cryopump of the related art uses activated carbon as an adsorbent, and in some uses, a gas containing oxygen is exhausted by the cryopump. In this case, the activated carbon is exposed to an oxygen atmosphere during regeneration. Since the activated carbon is a combustible material, accidental ignition may occur due to some factors. In order to reduce the possibility of an accident, it is important to avoid coexistence of a plurality of risk factors.

According to this embodiment, the adsorption area 64 includes a non-combustible adsorbent containing silica gel as a main component thereof. Therefore, even though oxygen is present, ignition and combustion of the adsorbent are reliably prevented. Unlike the related art, the coexistence of a plurality of risk factors such as activated carbon and oxygen is avoided, and thus the risk of ignition can be eliminated. Therefore, the safety of the cryopump 10 is improved. It is possible to provide the cryopump 10 suitable for the use in which oxygen is contained in the gas to be exhausted.

It is also conceivable to use other inorganic porous bodies such as a molecular sieve as the non-combustible adsorbent. In contrast, using silica gel as in this embodiment has an advantage of facilitating the regeneration of the cryopump 10. The adsorption property of the porous body generally has temperature dependence in which the adsorption amount decreases as a temperature rises. That is, when the porous body is heated, the gas adsorbed thereto is likely to be released. The silica gel has a significantly large decrease in adsorption characteristics at a high temperatures, compared to other inorganic porous bodies. Therefore, the non-combustible adsorbent containing silica gel is easily regenerated.

However, in a case where the gas which is exhausted to the cryopump 10 contains water vapor, a problem may occur. During the evacuation operation of the cryopump 10, water vapor is condensed in the first cryopanel unit 18 and becomes ice. During the regeneration, the cryopump 10 is heated to room temperature or a higher temperature (for example, a temperature in a range of 290 K to 330 K), and therefore, the ice melts into water. Many water droplets may be formed on the adsorbent.

Silica gel is a kind of hydrophilic material having an OH group. When such a hydrophilic adsorbent comes into contact with liquid water, hydrogen bonds are easily formed between the molecules of the adsorbent and water molecules. Since the hydrogen bond is a strong bond, dehydration of the adsorbent requires a considerable amount of time, and it is expected that the regeneration time will become long. This is not desirable. In addition, silica gel has the property of becoming brittle when it is immersed in liquid water, and then spontaneously shattering. Therefore, in a case where the hydrophilic adsorbent contains silica gel, it is particularly desirable to avoid the contact with liquid water.

Therefore, the regeneration of the cryopump 10 according to the embodiment is performed by sublimating ice to vaporize it into water vapor without passing through liquid water, and discharge it to the outside. Such an embodiment will be described below.

FIG. 3 is a block diagram of the cryopump 10 according to an embodiment. The cryopump 10 includes a regeneration controller 100, a storage unit or memory device 102, an input unit 104, and an output unit 106.

The regeneration controller 100 is configured to control the regeneration operation of the cryopump 10. The regeneration controller 100 is configured to receive the measurement results of various sensors including the first temperature sensor 90, the second temperature sensor 92, and the pressure sensor 94. The regeneration controller 100 calculates control commands which are provided to the cryocooler 16 and various valves, based on the measurement results. The regeneration controller 100 is configured to control the exhaust from the cryopump housing 70 and the supply of the purge gas to the cryopump housing 70 for the regeneration of the cryopump 10. The regeneration controller 100 controls the opening and closing of the rough valve 80 and the purge valve 84 during the regeneration.

The first temperature sensor 90 periodically measures the temperature of the first cryopanel unit 18 and generates a first temperature measurement signal S1 indicating the measured temperature of the first cryopanel unit 18. The first temperature sensor 90 is communicably connected to the regeneration controller 100 and outputs the first temperature measurement signal S1 to the regeneration controller 100. The second temperature sensor 92 periodically measures the temperature of the second cryopanel unit 20 and generates a second temperature measurement signal S2 indicating the measured temperature of the second cryopanel unit 20. The second temperature sensor 92 is communicably connected to the regeneration controller 100 and outputs the second temperature measurement signal S2 to the regeneration controller 100.

The pressure sensor 94 periodically measures the internal pressure of the cryopump housing 70 and generates a pressure measurement signal S3 indicating the internal pressure of the cryopump housing 70. The pressure sensor 94 is communicably connected to the regeneration controller 100 and outputs the pressure measurement signal S3 to the regeneration controller 100.

The storage unit 102 is configured to store data related to control of the cryopump 10. The storage unit 102 may be a semiconductor memory or another data storage medium. The input unit 104 is configured to receive an input from a user or another device. The input unit 104 includes, for example, input means, such as a mouse or a keyboard, for receiving an input from a user, and/or communication means for communicating with another device. The output unit 106 is configured to output data related to the control of the cryopump 10, and includes output means such as a display or a printer. The storage unit 102, the input unit 104, and the output unit 106 are communicably connected to the regeneration controller 100.

The regeneration controller 100 includes a first pressure rise rate monitoring unit or monitor 110, a second pressure rise rate monitoring unit or monitor 112, a temperature monitoring unit or monitor 114, a pressure monitoring unit or monitor 116, a rough valve drive unit or driver 118, and a purge valve drive unit or driver 120.

The first pressure rise rate monitor 110 receives the pressure measurement signal S3, calculates a pressure rise rate, based on the pressure measurement signal S3, and compares the pressure rise rate with a first threshold value. The first threshold value is set to a positive value, for example. The first pressure rise rate monitor 110 performs such a comparison when the cryopump 10 is being evacuated, that is, when the rough valve 80 is opened and the purge valve 84 is closed. The first threshold value is set in advance and stored in the storage unit 102.

The second pressure rise rate monitor 112 receives the pressure measurement signal S3, calculates a pressure rise rate, based on the pressure measurement signal S3, and compares the pressure rise rate with a second threshold value. The second threshold value is smaller than the first threshold value. The second threshold value is set to a negative value, for example. The second pressure rise rate monitor 112 performs such a comparison when the cryopump 10 is being evacuated. The second threshold value is set in advance and stored in the storage unit 102.

The temperature monitor 114 receives the first temperature measurement signal S1 and compares the measured temperature of the first cryopanel unit 18 with a purge stop temperature. Alternatively, the temperature monitor 114 may receive the second temperature measurement signal S2 and compare the measured temperature of the second cryopanel unit 20 with the purge stop temperature. The temperature monitor 114 performs such a comparison when the purge gas is being supplied to the cryopump 10, that is, when the purge valve 84 is opened and the rough valve 80 is closed. Further, the temperature monitor 114 compares the temperature inside the cryopump housing 70 (for example, the temperature of either the first cryopanel unit 18 or the second cryopanel unit 20) with a temperature threshold value. The temperature monitor 114 performs such a comparison when the cryopump 10 is being evacuated. The purge stop temperature and the temperature threshold value are set in advance and stored in the storage unit 102.

The pressure monitor 116 receives the pressure measurement signal S3 and compares the internal pressure of the cryopump housing 70 with a pressure threshold value. The pressure monitor 116 performs such a comparison when the cryopump 10 is being evacuated. The pressure threshold value is set in advance and stored in the storage unit 102.

The first pressure rise rate monitor 110 can acquire rough valve state data indicating whether the rough valve 80 is currently opened or closed from the rough valve driver 118. The first pressure rise rate monitor 110 can acquire purge valve state data indicating whether the purge valve 84 is currently opened or closed from the purge valve driver 120. Similarly, the second pressure rise rate monitor 112, the temperature monitor 114, and the pressure monitor 116 can acquire the rough valve state data from the rough valve driver 118 and acquire the purge valve state data from the purge valve driver 120.

The rough valve driver 118 determines whether or not a rough valve closing condition is satisfied, and generates a rough valve drive signal S4. The rough valve driver 118 determines whether or not the rough valve closing condition is satisfied, based on at least one of the comparison results of the first pressure rise rate monitor 110, the second pressure rise rate monitor 112, the temperature monitor 114, and the pressure monitor 116. The rough valve driver 118 outputs the rough valve drive signal S4 for closing the rough valve 80 to the rough valve 80 in a case where the rough valve closing condition is satisfied. The rough valve driver 118 outputs the rough valve drive signal S4 for opening the rough valve 80 to the rough valve 80 in a case where the rough valve closing condition is not satisfied. Further, the rough valve driver 118 generates rough valve state data.

The purge valve driver 120 determines whether or not a purge valve closing condition is satisfied, and generates a purge valve drive signal S5. The purge valve driver 120 determines whether or not the purge valve closing condition is satisfied, based on at least one of the comparison results of the first pressure rise rate monitor 110, the second pressure rise rate monitor 112, the temperature monitor 114, and the pressure monitor 116. The purge valve driver 120 outputs the purge valve drive signal S5 for closing the purge valve 84 to the purge valve 84 in a case where the purge valve closing condition is satisfied. The purge valve driver 120 outputs the purge valve drive signal S5 for opening the purge valve 84 to the purge valve 84 in a case where the purge valve closing condition is not satisfied. Further, the purge valve driver 120 generates purge valve state data.

The rough valve driver 118 may determine whether or not a rough valve opening condition is satisfied, based on at least one of the comparison results of the first pressure rise rate monitor 110, the second pressure rise rate monitor 112, the temperature monitor 114, and the pressure monitor 116. The rough valve driver 118 may control the rough valve 80 so as to open the rough valve 80 in a case where the rough valve opening condition is satisfied, and close the rough valve 80 in a case where the rough valve opening condition is not satisfied. Similarly, the purge valve driver 120 may control the purge valve 84 so as to open the purge valve 84 in a case where the purge valve opening condition is satisfied, and close the purge valve 84 in a case where the purge valve opening condition is not satisfied.

For example, the purge valve driver 120 may open the purge valve 84 when starting the regeneration of the cryopump 10, and close the purge valve 84 on the condition that the temperature monitor 114 determines that the measured temperature is higher than the purge stop temperature. The rough valve driver 118 may open the rough valve 80 on the condition that the temperature monitor 114 determines that the measured temperature is higher than the purge stop temperature.

The rough valve driver 118 may close the rough valve 80 on the condition that the second pressure rise rate monitor 112 determines that the pressure rise rate is smaller than the second threshold value. The rough valve driver 118 may close the rough valve 80 on the additional condition that the internal pressure of the cryopump housing 70 is lower than the pressure threshold value. The rough valve driver 118 may close the rough valve 80 on the additional condition that the temperature inside the cryopump housing 70 is higher than the temperature threshold value.

The regeneration controller 100 and the internal configurations of the regeneration controller 100, such as the first pressure rise rate monitor 110 and the second pressure rise rate monitor 112, are realized by, as a hardware configuration, an element or circuit including a CPU or a memory of a computer, and by, as a software configuration, a computer program or the like. However, in FIG. 3, it is appropriately depicted as functional blocks which are realized by the cooperation thereof. Those skilled in the art will understand that these functional blocks can be realized in various ways by combining hardware and software.

For example, the regeneration controller 100 can be implemented by a combination of a processor (hardware) such as a CPU (Central Processing Unit) or a microcomputer and a software program which is executed by the processor (hardware). Such a hardware processor may be configured by a programmable logic device such as FPGA (Field Programmable Gate Array), or may be a control circuit such as a programmable logic controller (PLC). The software program may be a computer program for causing the regeneration controller 100 to execute the regeneration sequence of the cryopump 10.

Figure 4:
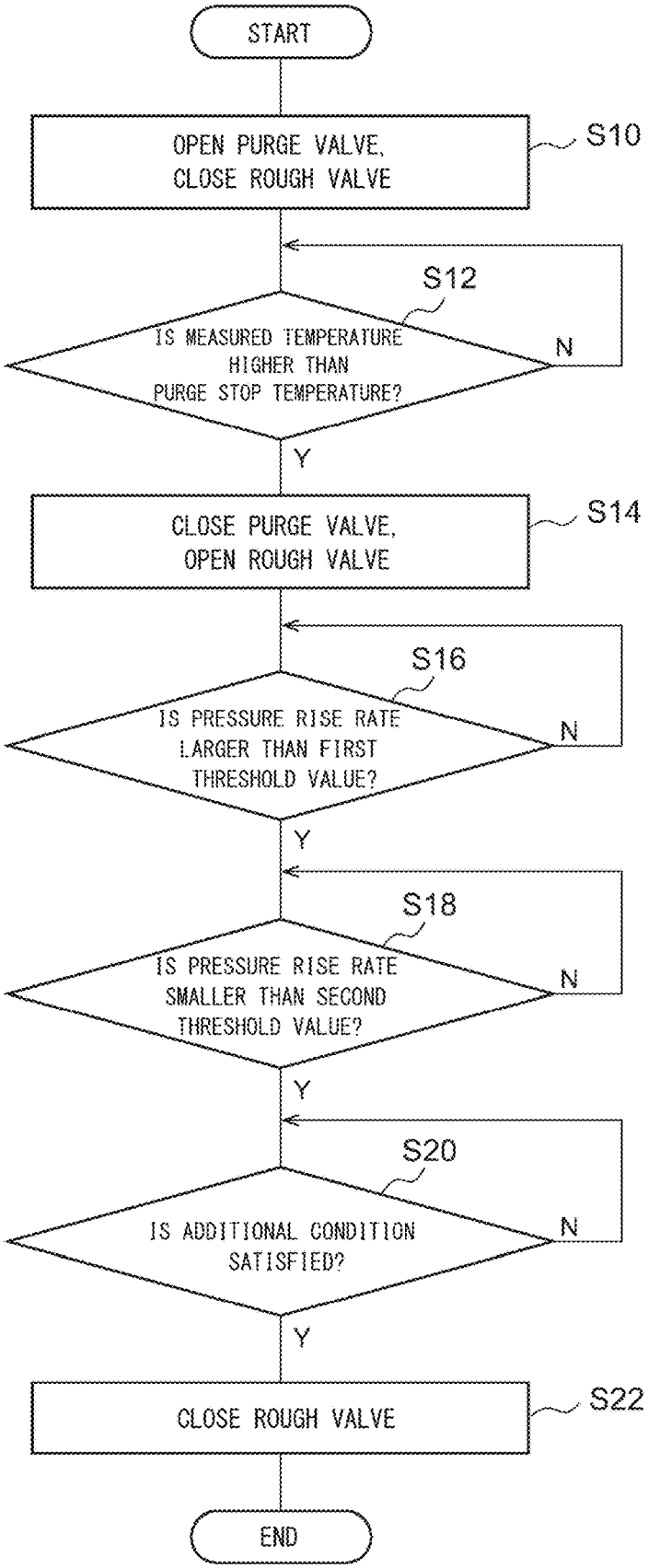
FIG. 4 is a flowchart showing a main part of a cryopump regeneration method according to an embodiment.

FIG. 4 is a flowchart showing a main part of a cryopump regeneration method according to an embodiment. When the regeneration sequence is started, the purge valve driver 120 opens the purge valve 84, and the rough valve driver 118 closes the rough valve 80 (S10). The purge gas is supplied from the purge gas source 86 to the cryopump housing 70 through the purge valve 84.

The temperature monitor 114 compares the measured temperature of the first cryopanel unit 18 with the purge stop temperature (S12). The rough valve driver 118 controls the rough valve 80 and the purge valve driver 120 controls the purge valve 84, based on the result of the comparison by the temperature monitor 114. Ina case where the measured temperature of the first cryopanel unit 18 is lower than the purge stop temperature (N in S12), the current state is maintained. That is, the purge valve 84 is opened and the rough valve 80 is closed. The temperature monitor 114 compares the measured temperature of the first cryopanel unit 18 with the purge stop temperature again after the elapse of a predetermined time (S12).

In a case where the measured temperature of the first cryopanel unit 18 is higher than the purge stop temperature (Y in S12), the purge valve driver 120 closes the purge valve 84 and the rough valve driver 118 opens the rough valve 80 (S14). The rough valve 80 may be opened some time after the purge valve 84 is closed.

The first pressure rise rate monitor 110 compares the pressure rise rate with the first threshold value (S16). The rough valve driver 118 controls the rough valve 80 and the purge valve driver 120 controls the purge valve 84, based on the result of the comparison by the first pressure rise rate monitor 110. In a case where the pressure rise rate is smaller than the first threshold value (N in S16), the current state is maintained. That is, the rough valve 80 is opened and the purge valve 84 is closed. The first pressure rise rate monitor 110 compares the pressure rise rate with the first threshold value again after the elapse of a predetermined time (S16).

In a case where the pressure rise rate is larger than the first threshold value (Y in S16), the second pressure rise rate monitor 112 compares the pressure rise rate with the second threshold value (S18). In this manner, the second pressure rise rate monitor 112 compares the pressure rise rate with the second threshold value on the condition that the first pressure rise rate monitor 110 determines that the pressure rise rate is larger than the first threshold value.

The rough valve driver 118 controls the rough valve 80 and the purge valve driver 120 controls the purge valve 84, based on the result of the comparison by the second pressure rise rate monitor 112. In a case where the pressure rise rate is larger than the second threshold value (N in S18), the current state is maintained. That is, the rough valve 80 is opened and the purge valve 84 is closed. The second pressure rise rate monitor 112 compares the pressure rise rate with the second threshold value again after the elapse of a predetermined time (S18).

In a case where the pressure rise rate is smaller than the second threshold value (Y in S18), it is determined whether or not an additional rough valve closing condition is satisfied (S20).

In this embodiment, the rough valve closing condition includes the following (2) and (3) in addition to "(1) the pressure rise rate is smaller than the second threshold value".

(2) The measured internal pressure of the cryopump housing 70 is lower than the pressure threshold value.

(3) The measured temperature of the second cryopanel unit 20 is higher than the temperature threshold value.

Therefore, the pressure monitor 116 compares the measured internal pressure of the cryopump housing 70 with the pressure threshold value. Further, the temperature monitor 114 compares the measured temperature of the second cryopanel unit 20 with the temperature threshold value. The rough valve driver 118 controls the rough valve 80 and the purge valve driver 120 controls the purge valve 84, based on the results of the comparison by the temperature monitor 114 and the pressure monitor 116.

In a case where the measured internal pressure of the cryopump housing 70 is higher than the pressure threshold value (N in S20), the current state is maintained. Even in a case where the measured temperature of the second cryopanel unit 20 is lower than the temperature threshold value (N in S20), the current state is maintained. That is, the rough valve 80 is opened and the purge valve 84 is closed. After the elapse of a predetermined time, whether or not these additional rough valve closing conditions are satisfied is determined again (S20).

In a case where the additional rough valve closing conditions are satisfied (Y in S20), that is, in a case where the measured internal pressure of the cryopump housing 70 is lower than the pressure threshold value and the measured temperature of the second cryopanel unit 20 is higher than the temperature threshold value, the rough valve 80 is closed (S22). The purge valve 84 may be opened simultaneously with the closing of the rough valve 80 or with some delay.

The pressure threshold value is selected from the pressure range of 10 Pa to 100 Pa, for example, and may be 30 Pa, for example. The temperature threshold value is selected from the temperature range of 290 K to 330 K, for example, and may be 300 K, for example.

After the rough valve 80 is closed in step S22, a further discharge process and a cool-down process (not shown) are performed, and the regeneration sequence ends.

Figure 5:
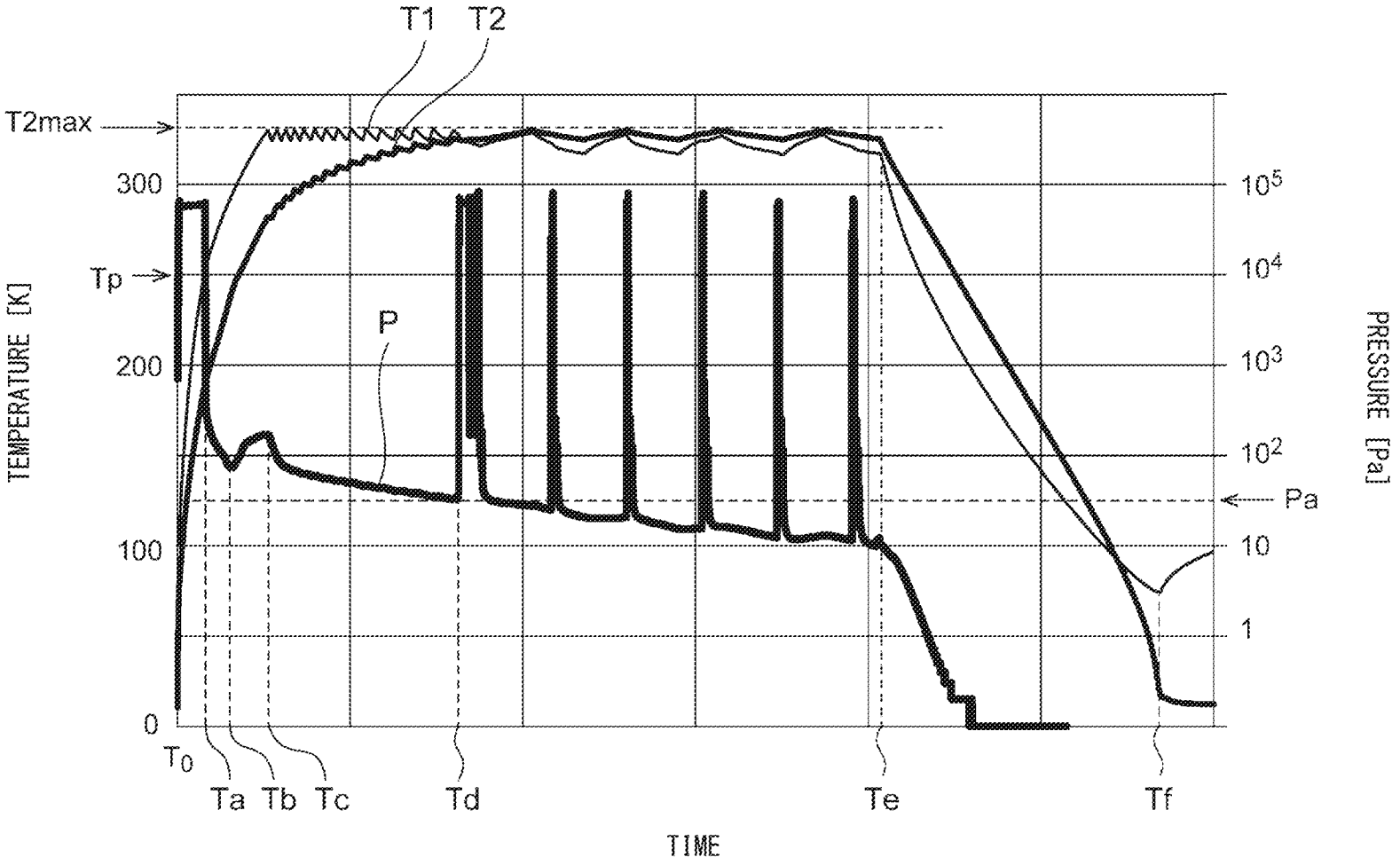
FIG. 5 shows an example of temporal changes in temperature and pressure in the regeneration method shown in FIG. 4.

FIG. 5 shows an example of temporal changes in temperature and pressure in the regeneration method shown in FIG. 4. In FIG. 5, reference symbols T1 and T2 respectively indicate the measured temperatures of the first cryopanel unit 18 and the second cryopanel unit 20. Temperature values are shown on the vertical axis on the left side. Reference symbol P indicates the measured internal pressure of the cryopump housing 70, and pressure values are shown in logarithm on the vertical axis on the right side.

When the regeneration sequence is started, the purge valve 84 is opened and the rough valve 80 is closed. The measured internal pressure P of the cryopump housing 70 increases to about atmospheric pressure due to the supply of the purge gas.

At the point in time of start $T_0$ of the regeneration sequence, the first cryopanel unit 18 is cooled to a cryogenic temperature of about 100 K, for example, and the second cryopanel unit 20 is cooled to a cryogenic temperature in a range of 10 to 20 K, for example. The first cryopanel unit 18 and the second cryopanel unit 20 are heated toward a purge stop temperature Tp by the purge gas and other heat sources provided in the cryopump 10.

The purge stop temperature Tp is set to a temperature value lower than the triple point temperature of water (that is, 273.15K). The purge stop temperature Tp may be set to a temperature near the triple point temperature of water and lower than that, for example, a temperature in a range of about 230 K to 270 K. The purge stop temperature Tp may be set to 250 K.

Among various gases captured by the cryopump 10, most of the components except water vaporize in the initial stage of the regeneration, at which the cryopump 10 is heated to the purge stop temperature Tp. Water is less likely to vaporize than these other gases, and remains as solid ice on the first cryopanel unit 18 at the point in time when the cryopump 10 reaches the purge stop temperature Tp.

At a timing Ta shown in FIG. 5, the measured temperature T1 of the first cryopanel unit 18 reaches the purge stop temperature Tp. Then, the purge valve 84 is closed and the supply of purge gas to the cryopump housing 70 is stopped. In this way, the supply of the purge gas to the cryopump 10 is stopped before the cryopanel temperature exceeds the triple point temperature of water.

This regeneration sequence is so-called full regeneration, and both the first cryopanel unit 18 and the second cryopanel unit 20 are regenerated. Therefore, the cryopump 10 is continuously heated and is raised in temperature to room temperature or a regeneration temperature (in a range of 290 K to 330 K, for example) higher than room temperature. In this manner, maintaining the cryopump 10 at a relatively high temperature during the regeneration contributes to shortening of the regeneration time.

In FIG. 5, a setting temperature T2max of the second cryopanel unit 20 is shown. The temperature T2 of the second cryopanel unit 20 is maintained near the setting temperature T2max until the cool-down is started during the regeneration. For example, the setting temperature T2max may be used as an upper limit temperature of the second cryopanel unit 20, and the temperature T2 of the second cryopanel unit 20 may be maintained between the setting temperature T2max and a lower limit temperature T2max−ΔT by the regeneration controller 100. The temperature margin ΔT may be, for example, a temperature in a range of about 5 to 10 K. Alternatively, the temperature T2 of the second cryopanel unit 20 may be maintained in a temperature range of T2max±ΔT.

At the timing Ta, the purge valve 84 is closed and the rough valve 80 is opened. The evacuation of the cryopump 10 starts. The various gases that have already vaporized are exhausted to the rough pump 82 through the rough valve 80. The measured internal pressure P of the cryopump housing 70 sharply decreases (the pressure rise rate becomes a negative value). The measured internal pressure P of the cryopump housing 70 is maintained at a value lower than the triple point pressure (611 Pa) of water.

The pressure rise rate gradually approaches zero and finally becomes a positive value at a timing Tb shown in FIG. 5. The measured internal pressure P of the cryopump housing 70 changes from decreasing to increasing. This pressure rise occurs because ice condensed in the cryopump 10 vaporizes by sublimation.

The pressure rise rate gradually decreases as the sublimation of ice proceeds, and eventually, the pressure rise rate becomes a negative value at a timing Tc shown in FIG. 5. The measured internal pressure P of the cryopump housing 70 turns from increasing to decreasing again. At this point in time, it is considered that most of the ice has vaporized. The vaporized water vapor is exhausted to the rough pump 82 through the rough valve 80.

The regeneration controller 100 detects a "peaks" of the pressure fluctuation due to the sublimation of ice. The first pressure rise rate monitor 110 detects the rising of the "peak" of the pressure fluctuation, and the second pressure rise rate monitor 112 detects the end of the "peak" of the pressure fluctuation.

When the evacuation of the cryopump 10 is further continued and the internal pressure of the cryopump 10 becomes sufficiently low, the rough valve 80 is closed and the evacuation of the cryopump 10 is ended (timing Td in FIG. 5). More specifically, when the measured internal pressure P of the cryopump housing 70 is lower than a pressure threshold value Pa and the measured temperature T2 of the second cryopanel unit 20 is higher than the temperature threshold value, the rough valve 80 is closed.

Subsequently, as shown in FIG. 5, so-called rough-and-purge may be performed. The rough-and-purge is a process of alternately repeating the supply of the purge gas to the cryopump 10 and the evacuation. Some of water vapor vaporized by sublimation can be adsorbed to the adsorbent. The rough-and-purge can help discharge the water vapor adsorbed to the adsorbent. During the rough-and-purge, the internal pressure and the pressure rise rate of the cryopump 10 are monitored, and when these satisfy predetermined values (timing Te in FIG. 5), the cool-down of the cryopump 10 is started. When each of the first cryopanel unit 18 and the second cryopanel unit 20 is cooled to a target cooling temperature (timing Tf in FIG. 5), the regeneration is completed.

As described above, according to this embodiment, ice vaporizes into water vapor by sublimation without passing through liquid water. Therefore, the hydrophilic adsorbent does not come into contact with liquid water during the regeneration. Since the amount of water which is adsorbed to the adsorbent is reduced, the time required for dehydrating the adsorbent can be shortened. Therefore, the regeneration time can be shortened.

Further, as described above, silica gel has the property of becoming brittle when it is immersed in liquid water and then spontaneously shattering. However, according to this embodiment, the hydrophilic adsorbent does not come into contact with liquid water during the regeneration. Therefore, in a case where the hydrophilic adsorbent contains silica gel, the hydrophilic adsorbent can be made to last longer.

Figure 6:
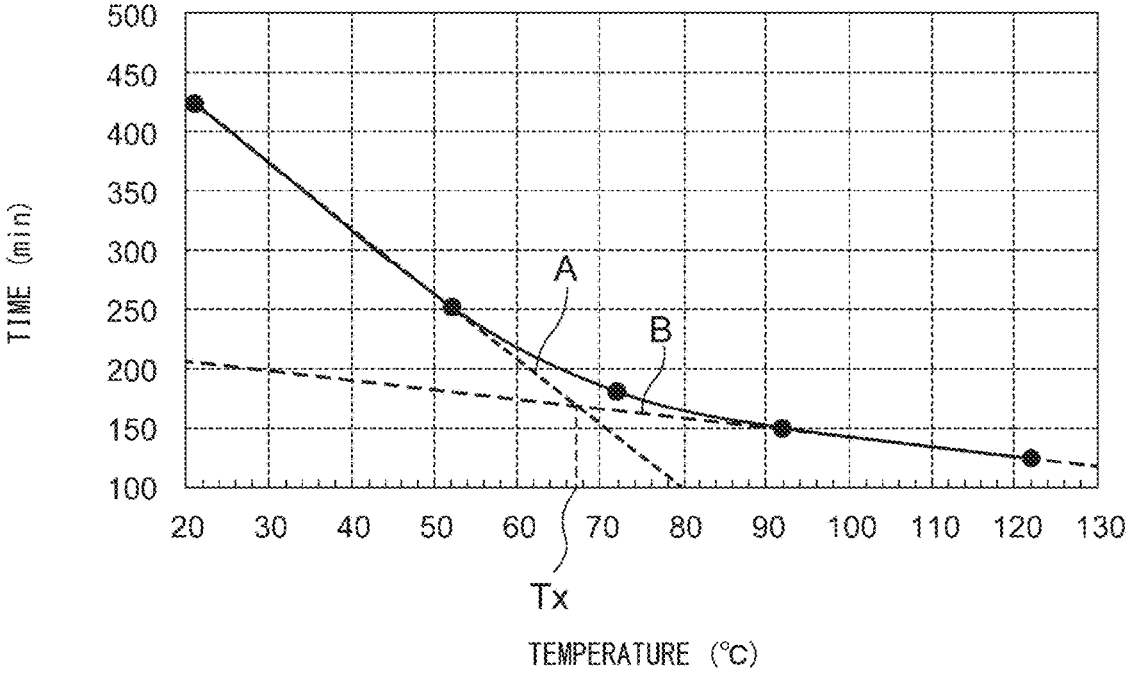
FIG. 6 is a graph showing an example of the relationship between a cryopanel maximum temperature during regeneration and a discharge completion time.

FIG. 6 is a graph showing an example of the relationship between the maximum temperature of the cryopanel during the regeneration and a discharge completion time. The horizontal axis of FIG. 6 represents the setting temperature T2max of the second cryopanel unit 20, and the vertical axis represents a time required from the start of the regeneration to the completion of discharge. Here, the discharge completion refers to a point in time (for example, the timing Te in FIG. 5) at which the internal pressure and the pressure rise rate of the cryopump housing 70 satisfy predetermined values. In FIG. 6, plotted are the measurement results of the discharge completion time in a case where a fixed amount of water is introduced into the cryopump 10 (that is, the adsorption area 64 contains silica gel as a main component) shown in FIG. 1 in five cases having different setting temperatures T2max (20° C., 52° C., 72° C., 92° C., 122° C.) are different from each other.

As shown in FIG. 6, the discharge completion time is shortened as the setting temperature T2max increases. More specifically, the discharge completion time changes along a straight line A in a case where the setting temperature T2max is lower than about 70° C., and changes along a straight line B in a case where the setting temperature T2max is higher than about 70° C. Both the straight lines A and B have a negative slope. However, the magnitude of the slope of the straight line A is larger than that of the straight line B.

Therefore, the shortening amount of the discharge completion time when the setting temperature T2max is increased from room temperature (for example, 20° C.) is relatively large at the setting temperature T2max of about 70° C. or lower, and is not so large at the setting temperature T2max of about 70° C. or higher. According to FIG. 6, the discharge completion time can be read as about 420 minutes when the setting temperature T2max is 20° C., and the discharge completion time can be read as about 180 minutes when the setting temperature T2max is 70° C. Therefore, by increasing the setting temperature T2max from 20° C. to 70° C., the discharge completion time is shortened by about 240 minutes. Further, the discharge completion time can be read as about 130 minutes when the setting temperature T2max is 120° C. Therefore, by increasing the setting temperature T2max from 70° C. to 120° C., the discharge completion time is shortened by about 50 minutes. In this manner, when the setting temperature T2max is about 70° C. or higher, the discharge completion time does not depend so much on the setting temperature T2max. Therefore, it is preferable that the setting temperature T2max is at least 70° C.

A temperature Tx at the intersection of the straight lines A and B may change somewhat depending on various conditions such as the amount of water introduced into the cryopump 10. However, according to the study by the inventor of the present invention, the temperature Tx is expected to be in the temperature range of about 65° C. to about 75° C. Therefore, the setting temperature T2max may be higher than the temperature selected from this temperature range, and may be, for example, 65° C. or higher, 70° C. or higher, or 75° C. or higher.

Incidentally, the water adsorption capacity of silica gel has temperature dependence. At room temperature or a temperature lower than it, silica gel adsorbs water well. For example, 100 g of silica gel adsorbs, for example, 25 g or more of water (that is, 25 wt % water adsorption amount). However, the water adsorption capacity of silica gel significantly decreases as the temperature rises above room temperature. For example, at 80° C., the amount of adsorbed water falls below 5 wt %, for example, and at 90° C., the water adsorption capacity is almost (or completely) lost. Therefore, in a case where the adsorption area 64 contains silica gel, the setting temperature T2max may be 80° C. or higher or 90° C. or higher in order to favorably release the adsorbed water from the silica gel.

In a case where the setting temperature T2max is set too high, the effect of shortening the discharge completion time is small as described above. However, there is a risk of exceeding the heat resistant temperature of the cryopump 10. Therefore, the setting temperature T2max may be 130° C. or lower, 120° C. or lower, 110° C. or lower, 100° C. or lower, or 95° C. or lower.

Ina case where the cryopump 10 is heated by, for example, a reverse rotation temperature raising operation of the cryocooler 16, the temperature of an internal constituent part (for example, the second displacer) of the cryocooler 16 tends to become higher than the measured temperature of the second cryopanel unit 20. Therefore, in a case where the reverse rotation temperature raising operation of the cryocooler 16 is used, the setting temperature T2max may be a relatively low temperature, for example, 100° C. or lower, or 95° C. or lower in consideration of the heat resistant temperatures of the internal constituent part of the cryocooler 16. The setting temperature T2max may be a temperature lower than the boiling point of water.

Therefore, the regeneration controller 100 may be configured to raise the temperature of the adsorption area 64 to 65° C. or higher (or 70° C. or higher, 75° C. or higher, 80° C. or higher, or 90° C. or higher) during the regeneration. The regeneration controller 100 may be configured to raise the temperature of the adsorption area 64 to 130° C. or lower (or 120° C. or lower, 110° C. or lower, 100° C. or lower, or 95° C. or lower) during the regeneration.

As an example, the temperature monitor 114 compares the measured temperature of the second cryopanel unit 20 with the upper limit temperature during the regeneration (for example, the setting temperature T2max or T2max+AT). In a case where the measured temperature does not exceed the upper limit temperature during the heating of the cryopump 10, the temperature monitor 114 continues to heat the cryopump 10 (the first cryopanel unit 18 and/or the second cryopanel unit 20). Ina case where the measured temperature exceeds the upper limit temperature during the heating of the cryopump 10, the temperature monitor 114 stops the heating of the cryopump 10.

Further, the temperature monitor 114 compares the measured temperature of the second cryopanel unit 20 with the lower limit temperature (for example, T2max-AT). In a case where the measured temperature exceeds the lower limit temperature during the stop of the heating of the cryopump 10, the temperature monitor 114 continues to stop the heating of the cryopump 10. In a case where the measured temperature falls below the lower limit temperature during the stop of the heating of the cryopump 10, the temperature monitor 114 heats the cryopump 10.

The heating of the cryopump 10 is performed using a heating device provided in the cryopump 10 (for example, the reverse rotation temperature raising operation of the cryocooler 16, an electric heater mounted to the cryocooler 16, or the like). The regeneration controller 100 controls the heating device so as to switch between the heating and the stop of the heating of the cryopump 10. For example, the heating and the stop of the heating of the cryopump 10 are switched by turning on and off the heating device.

In this way, by heating the adsorption area 64 to 65° C. or higher during the regeneration, it is possible to greatly shorten the completion time of water discharge from the cryopump 10, and thus the regeneration time.

Figure 7:
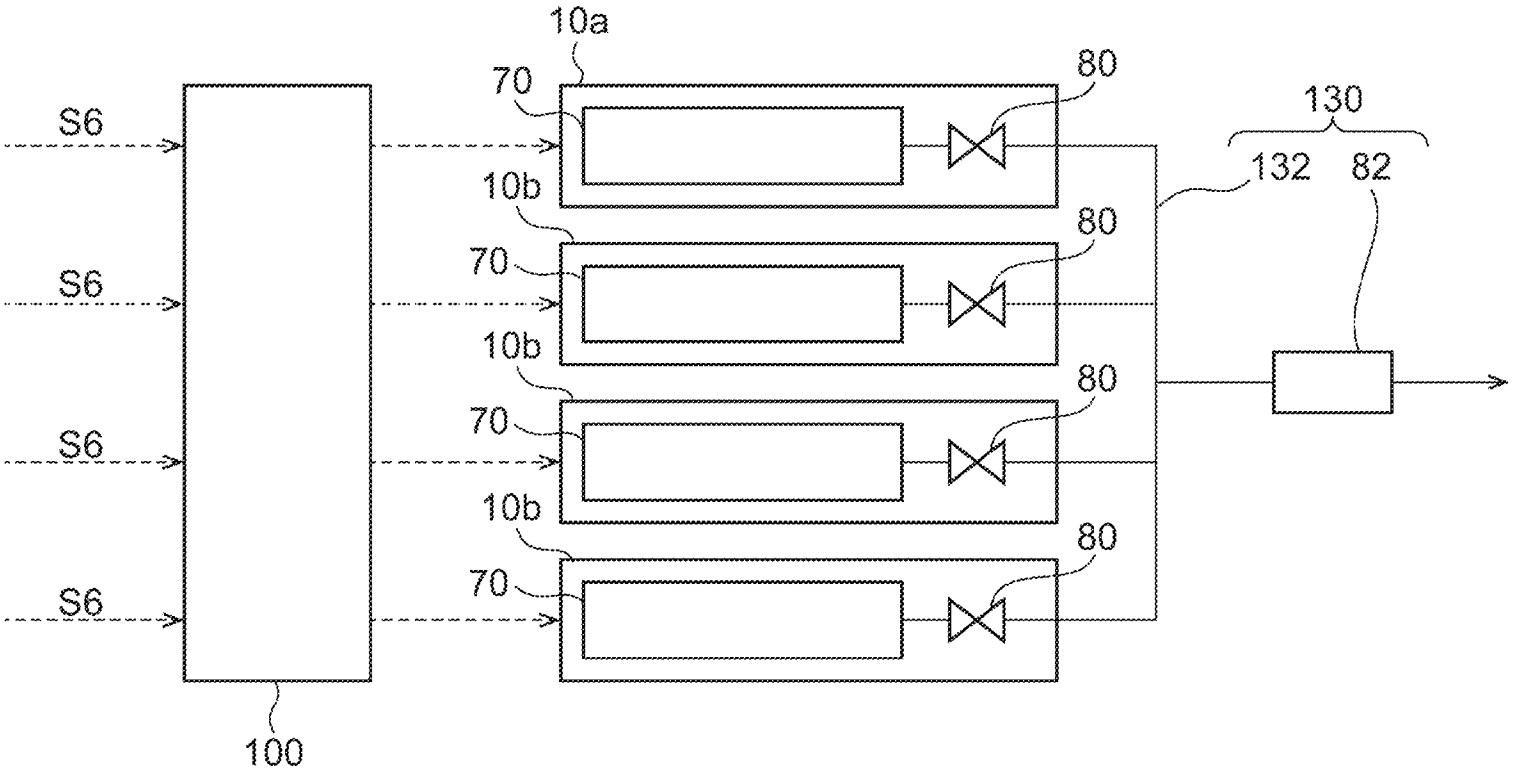
FIG. 7 is a diagram schematically showing a cryopump system according to an embodiment.

FIG. 7 is a diagram schematically showing a cryopump system according to an embodiment. The cryopump system includes a plurality of cryopumps, and specifically includes at least one first cryopump 10*a* and at least one second cryopump 10*b*. In the example shown in FIG. 7, the cryopump system is composed of a total of four cryopumps including one first cryopump 10*a* and three second cryopumps 10*b*. However, the number of first cryopumps 10*a* and the number of second cryopumps 10*b* are not particularly limited. The plurality of cryopumps may be installed to separate vacuum chambers, or may be installed to one same vacuum chamber.

The first cryopump 10*a* is a cryopump having an adsorbent containing silica gel as a main component thereof, and is, for example, the cryopump 10 shown in FIG. 1. The second cryopump 10*b* is a cryopump having an adsorbent (for example, activated carbon) which does not contain silica gel. The second cryopump 10*b* has the same configuration as the cryopump 10 shown in FIG. 1 except for the adsorbent. Therefore, the first cryopump 10*a* includes the cryopump housing 70 and the rough valve 80. Similarly, the second cryopump 10*b* includes the cryopump housing 70 and the rough valve 80.

The cryopump system includes a rough exhaust line 130. The rough exhaust line 130 includes a rough pump 82 that is common to the first cryopump 10*a* and the second cryopumps 10*b*, and a rough pipe 132 that allows the rough valve 80 of each of the cryopumps (10*a*, 10*b*) merge with the common rough pump 82.

The regeneration controller 100 is configured to receive a regeneration start command S6 for each of the cryopumps (10*a*, 10*b*) and start the regeneration of the cryopump. The regeneration start command S6 is input to the regeneration controller 100 from the input unit 104 (refer to FIG. 3), for example.

Incidentally, since the respective cryopumps (10*a*, 10*b*) are connected to each other through the rough exhaust line 130, in a case where the regeneration is performed in parallel by several cryopumps, gas may flow back from a cryopump (referred to as a cryopump A) to another cryopump (referred to as a cryopump B). For example, in a case where the cryopump B shifts from purge to roughing while the rough pump 82 is roughing the cryopump A, at the point in time of the shift, the internal pressure of the cryopump B becomes higher than that of the cryopump A due to the purge gas. Therefore, the gas can flow back from the cryopump B to the cryopump A through the rough pipe 132 due to the pressure difference between the two cryopumps.

Such the back-flow of a gas is not desired especially in a case where the cryopump A is the first cryopump 10*a*. This is because the pressure of the first cryopump 10*a* increases due to the back-flow and the internal pressure can exceed the triple point pressure of water. In that case, ice can be liquefied into water in the first cryopump 10*a*. The risk of silica gel contained in the adsorbent coming into contact with liquid water increases.

Further, there is also a concern that particles may enter the cryopump due to the back-flow which is generated from the rough pipe 132 to the cryopumps (10*a*, 10*b*).

Therefore, in a case where the regeneration controller 100 receives the regeneration start command S6 for at least one other cryopump (that is, the second cryopump 10*b*) during the regeneration of the first cryopump 10*a*, the regeneration controller 100 may delay the regeneration start of at least one other cryopump until after the regeneration of the first cryopump 10*a* is completed.

Therefore, during the regeneration of the first cryopump 10*a*, the rough valves 80 of the other cryopumps continue to be closed, and the common rough pump 82 is used as a dedicated rough pump for the first cryopump 10*a*. Therefore, it is possible to prevent the back-flow of the gas from the other cryopumps to the first cryopump 10*a* which is being regenerated.

In this case, the regeneration controller 100 may continue the evacuation operation of the other cryopumps that have received the regeneration start command S6 (that is, the evacuation of the vacuum chamber by the cryopump). Alternatively, the regeneration controller 100 may stop the evacuation operations of the other cryopumps that have received the regeneration start command S6. In this way, the cryocooler 16 of the cryopump stops the cooling operation, and the cryopump can be naturally heated.

Further, the regeneration controller 100 may interrupt the regeneration of the second cryopump 10*b* in a case of receiving the regeneration start command S6 for the first cryopump 10*a* during the regeneration of the second cryopump 10*b*. In this manner, the regeneration of the first cryopump 10*a* may be performed in preference to the regeneration of the second cryopump 10*b*. The regeneration of the second cryopump 10*b* may be restarted after the regeneration of the first cryopump 10*a* is completed, or may be restarted from the beginning.

Alternatively, in a case where the regeneration controller 100 receives the regeneration start command S6 for the first cryopump 10*a* during the regeneration of the second cryopump 10*b*, the regeneration controller 100 may delay the start of regeneration of the first cryopump 10*a* until after the regeneration of the second cryopump 10*b* is completed.

Ina case where the regeneration controller 100 receives the regeneration start command S6 for the other second cryopumps 10*b* during the regeneration of any of the second cryopumps 10*b*, the regeneration controller 100 may perform the regeneration of the second cryopumps 10*b* in parallel.

There is also a case where the cryopump system may include a plurality of first cryopumps 10*a*. In that case, when the regeneration controller 100 receives the regeneration start command S6 for the other first cryopumps 10*a* during the regeneration of any one of the first cryopump 10*a*, the regeneration controller 100 may sequentially regenerate the first cryopumps 10*a* one by one without performing the regeneration of the first cryopumps 10*a* in parallel.

The present invention has been described above based on the examples. It will be understood by those skilled in the art that the present invention is not limited to the embodiments described above, various design changes can be made, various modification examples can be made, and such modification examples are also within the scope of the present invention. Various features described in connection with an embodiment may also be applicable to other embodiments. A new embodiment that results from the combination also has the effects of each of the embodiments which are combined.

In the embodiment described above, the rough valve closing condition is set to satisfy all of the following (1) to (3). However, there is no limitation thereto.

(1) The pressure rise rate is smaller than the second threshold value.

(2) The measured internal pressure of the cryopump housing 70 is lower than the pressure threshold value.

(3) The measured temperature of the second cryopanel unit 20 is higher than the temperature threshold value.

For example, the rough valve closing condition may be only (1). In that case, step S20 shown in FIG. 4 may be omitted. Therefore, in a case where the pressure rise rate is smaller than the second threshold value (Y in S18), the rough valve 80 may be closed (S22).

Alternatively, the rough valve closing condition may be at least one of (1) and (2). In this way, the evacuation of the cryopump can be stopped based on at least one of the pressure in the cryopump and the pressure rise rate.

Further, the rough valve closing conditions may be (2) and (3). In that case, steps S16 and S18 shown in FIG. 4 may be omitted.

Instead of the condition (3) or together with the condition (3), the following condition (3') may be used as the rough valve closing condition.

(3') The measured temperature of the first cryopanel unit 18 is higher than the temperature threshold value.

In the embodiment described above, the purge gas is supplied to the cryopump housing 70 at the same time as the start of the regeneration sequence. However, when ice condensed in the cryopump 10 vaporizes by sublimation and discharged to the outside of the cryopump 10, the supply of the purge gas is not essential. Further, it is not essential to actively heat the cryopump 10 for sublimation. Instead of operating the heating device, the cryopump 10 may be naturally heated by heat inflow from the surrounding environment. Such an embodiment will now be described.

Figure 8:
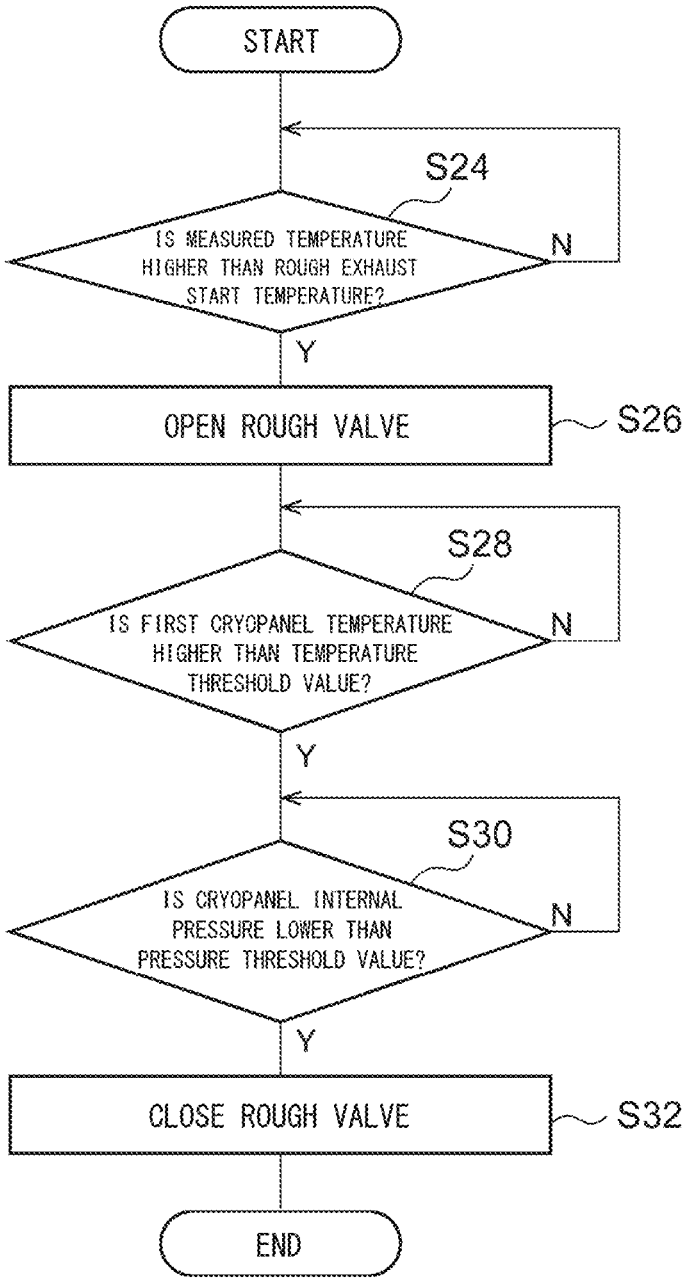
FIG. 8 is a flowchart showing an example of a water discharge process by sublimation according to an embodiment.

FIG. 8 shows another example of the water discharge process by sublimation. In this example, the purge valve 84 is closed and the purge gas is not supplied to the cryopump housing 70. The water vapor vaporized by sublimation is discharged from the cryopump housing 70 by the evacuation of the cryopump housing 70 through the rough valve 80 by the rough pump 82. The above (2) and (3') are used as the rough valve closing conditions. The operation of the cryocooler 16 is stopped.

First, the temperature monitor 114 compares the measured temperature of the first cryopanel unit 18 with a rough exhaust start temperature (S24). The rough exhaust start temperature may be equal to the purge stop temperature in the embodiment described above. The rough valve driver 118 controls the rough valve 80, based on the result of the comparison by the temperature monitor 114.

In a case where the measured temperature of the first cryopanel unit 18 is lower than the rough exhaust start temperature (N in S24), the rough valve 80 is closed. The temperature monitor 114 compares the measured temperature of the first cryopanel unit 18 with the rough exhaust start temperature again after the elapse of a predetermined time (S24). In a case where the measured temperature of the first cryopanel unit 18 is higher than the rough exhaust start temperature (Y in S24), the rough valve driver 118 opens the rough valve 80 (S26).

Next, the temperature monitor 114 compares the measured temperature of the first cryopanel unit 18 with the temperature threshold value (S28). In a case where the cryopump 10 is not actively heated, the temperature of the cryopump 10 does not exceed the ambient temperature (for example, room temperature). Therefore, this temperature threshold value may be selected from the ambient temperature or a value lower than the ambient temperature, for example, a temperature in a range of 260 to 300 K, and it may be, for example 280 K. In a case where the measured temperature of the first cryopanel unit 18 is lower than the temperature threshold value (N in S28), the opening of the rough valve 80 is continued, and the temperature comparison and determination are performed again after the elapse of a predetermined time (S28).

In a case where the measured temperature of the first cryopanel unit 18 is higher than the temperature threshold value (Y in S28), a pressure determination is performed. The pressure monitor 116 compares the measured internal pressure of the cryopump housing 70 with the pressure threshold value (S30). In a case where the measured internal pressure of the cryopump housing 70 is higher than the pressure threshold value (N in S30), the opening of the rough valve 80 is continued, and the pressure comparison and determination are performed again after the elapse of a predetermined time (S30). In a case where the measured internal pressure of the cryopump housing 70 is lower than the pressure threshold value (Y in S30), the rough valve 80 is closed (S32). In this way, the water discharge process by sublimation ends.

Figure 9:
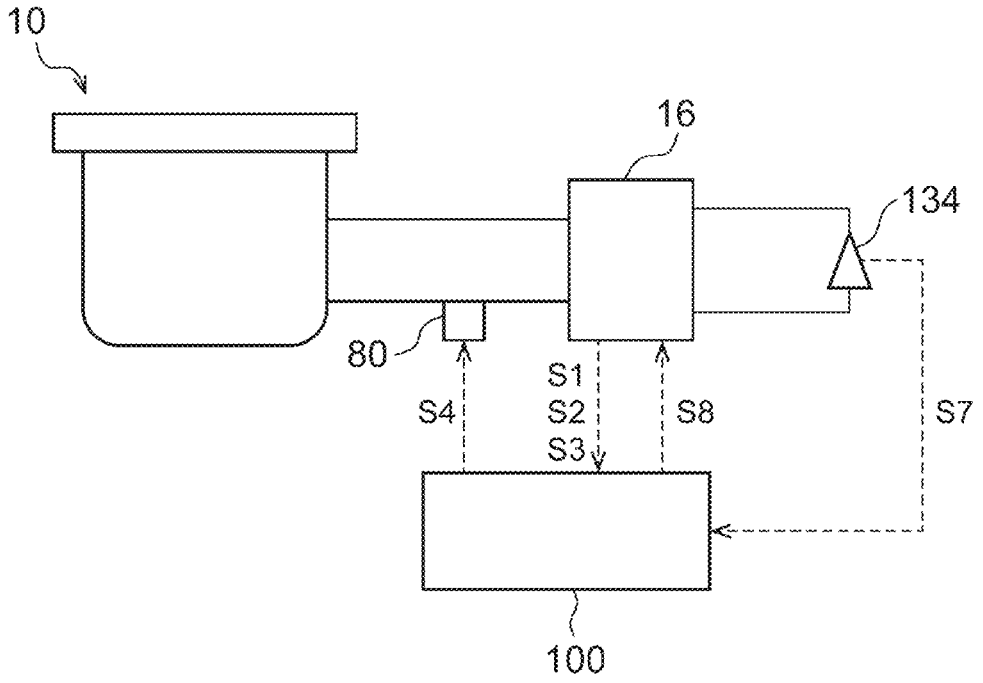
FIG. 9 is a diagram schematically showing another example of the cryopump according to another embodiment.

FIG. 9 is a diagram schematically showing another example of the cryopump according to an embodiment. The cryopump 10 includes a compressor 134 that supplies a working gas (for example, helium gas) to the cryocooler 16. The compressor 134 recovers the working gas from the cryocooler 16, compresses and pressurizes the recovered working gas, and supplies the working gas to the cryocooler 16 again. Further, similarly to the embodiment described above, the cryopump 10 includes the regeneration controller 100 that generates the rough valve drive signal S4, based on the first temperature measurement signal S1, the second temperature measurement signal S2, and the pressure measurement signal S3.

Incidentally, the compressor 134 may abnormally stop due to various factors, for example, severe fluctuations such as air temperature, humidity, and atmospheric pressure, which exceed the assumption of the installation environment of the compressor 134, an abnormal decreases in quality of a cooling medium such as cooling water, failure of cooling equipment of the compressor 134, or the like.

In order to detect the abnormal stop of the compressor 134, the compressor 134 is configured to output a compressor signal S7 indicating the operating state of the compressor 134 (for example, ON/OFF of the compressor 134) to the regeneration controller 100. As an example, the compressor signal S7 is, for example, a DC 24 V or other constant voltage signals, and is constantly output during the operation of the compressor 134, and is not output during a stop such as an abnormal stop.

Therefore, the regeneration controller 100 determines that the compressor 134 is operating, in a case where the compressor signal S7 is detected, and determines that the compressor 134 is abnormally stopped, in a case where the compressor signal S7 is not detected. Further, the regeneration controller 100 outputs a cryocooler control signal S8 to the cryocooler 16, based on the compressor signal S7. For example, in a case where the compressor signal S7 is not detected, the regeneration controller 100 stops the power supply to the cryocooler 16 and thereby stops the operation of the cryocooler 16. In this way, the operation of the cryocooler 16 can be stopped in synchronization with the abnormal stop of the compressor 134.

When the cryocooler 16 is stopped due to the abnormal stop of the compressor 134, heat flows into the cryopump 10 from the ambient environment, and the temperatures of the first cryopanel unit 18 and the second cryopanel unit 20 may rise. Even in such a situation, it is desirable to prevent the melting of ice condensed on the cryopanel and the contact between liquid water that may result from the melting and the adsorbent (for example, silica gel). Therefore, the cryopump 10 operates to vaporize and discharge the ice condensed in the cryopump 10 by sublimation during the abnormal stop of the compressor 134.

Figure 10:
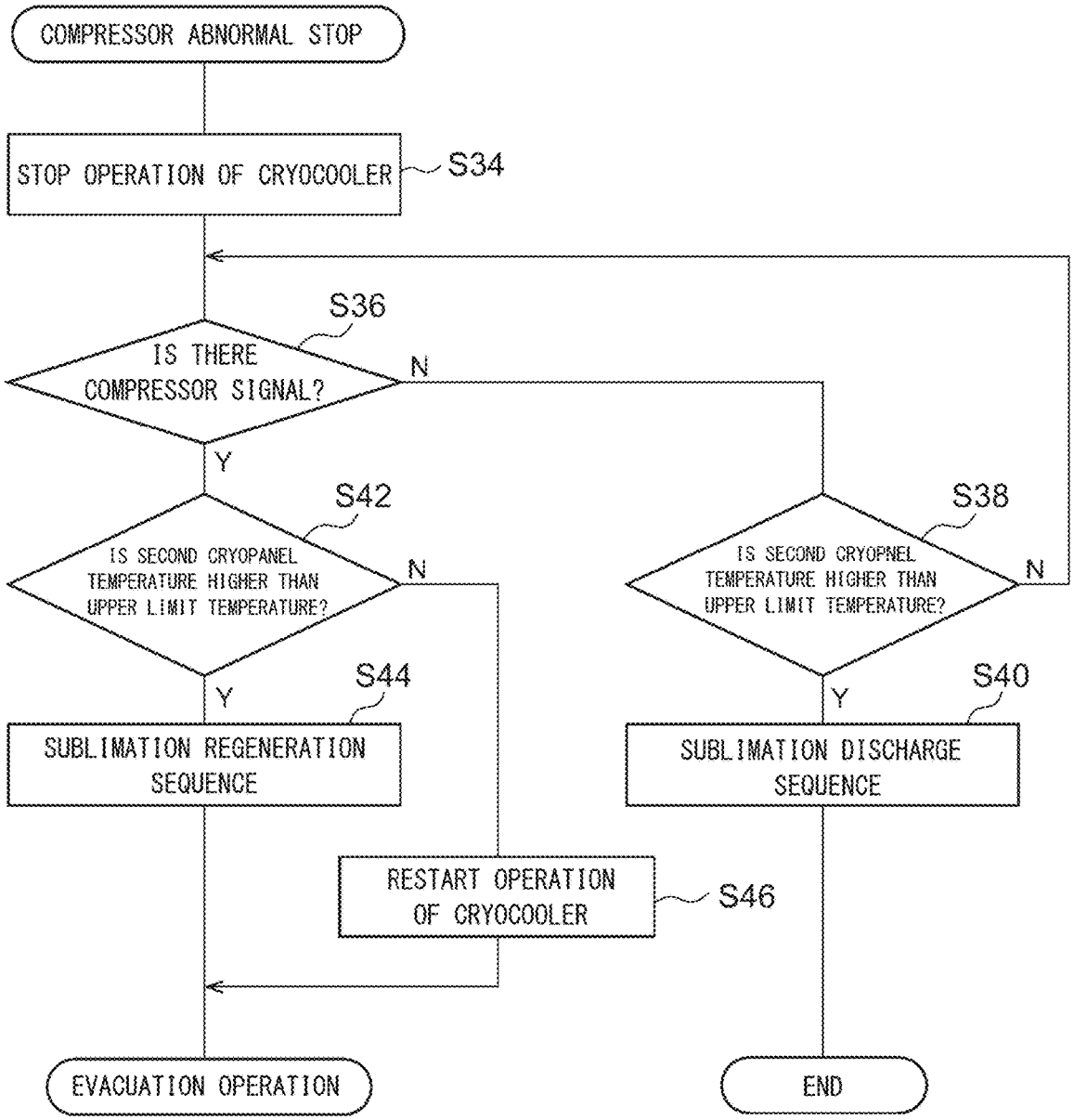
FIG. 10 is a flowchart showing processing which is executed by a cryopump when an abnormal stop of a compressor has occurred, according to an embodiment.

FIG. 10 is a flowchart illustrating processing which is executed by the cryopump when an abnormal stop of the compressor has occurred, according to an embodiment. As shown in FIG. 10, when the abnormal stop of the compressor 134 has occurred, the regeneration controller 100 stops the operation of the cryocooler 16, based on the compressor signal S7 (S34). In a case where a gate valve is installed between the cryopump 10 and the vacuum chamber, the gate valve may be closed together with the stop of the cryocooler 16.

The regeneration controller 100 determines the presence or absence of the compressor signal S7 (S36). In a case where there is no compressor signal S7 (N in S36), the regeneration controller 100 (for example, the temperature monitor 114) compares the measured temperature of the second cryopanel unit 20 with an upper limit temperature (S38). This upper limit temperature is set as, for example, the maximum value of a standard operating temperature in the evacuation operation of the cryopump 10, and is selected from the range of 20 to 30 K, and it may be 25 K, for example. In a case where the measured temperature of the second cryopanel unit 20 is lower than the upper limit temperature (N in S38), the regeneration controller 100 waits and determines the presence or absence of the compressor signal S7 again after the elapse of a predetermined time (S36).

In a case where the measured temperature of the second cryopanel unit 20 is higher than the upper limit temperature (Y in S38), the regeneration controller 100 executes the sublimation discharge sequence (S40). For the sublimation discharge sequence, for example, the water discharge process by sublimation shown in FIG. 8 can be adopted. In this way, In a case where the abnormal stop of the compressor 134 is generated and the temperature of the second cryopanel unit 20 exceeds the upper limit temperature, the ice condensed in the cryopump 10 is vaporized by sublimation and can be discharged to the outside of the cryopump 10. Since water is removed from the periphery of the adsorption area 64, it is possible to prevent the adsorption area 64 from getting wet while the compressor 134 that has abnormally stopped is repaired or replaced. When the sublimation discharge sequence is completed, the cryopump 10 stands by while the cooling operation of the cryocooler 16 is stopped.

On the other hand, even in a case where there is the compressor signal S7 (Y in S36), the regeneration controller 100 (for example, the temperature monitor 114) compares the measured temperature of the second cryopanel unit 20 with the upper limit temperature (S42). In a case where the measured temperature of the second cryopanel unit 20 is higher than the upper limit temperature (Y in S42), the regeneration controller 100 executes the sublimation regeneration sequence (S44). For the sublimation regeneration sequence, for example, the regeneration sequence described with reference to FIGS. 4 and 5 can be adopted. When the regeneration is completed, the cryopump 10 returns to the evacuation operation. Since water is removed from the periphery of the adsorption area 64, it is possible to prevent the contact between liquid water and the adsorbent (for example, silica gel).

Further, in a case where the measured temperature of the second cryopanel unit 20 is lower than the upper limit temperature (N in S42), the regeneration controller 100 restarts the cooling operation of the cryocooler 16 (S46) without performing the sublimation regeneration of the cryopump 10 and returns to the evacuation operation. Since the adsorption area 64 is maintained at a cryogenic temperature, it does not come into contact with liquid water.

The cryopump regeneration according to the embodiment is suitable in a case where the amount of water condensed in the cryopump 10 is small and the internal pressure of the cryopump 10 does not exceed the triple point pressure of water due to sublimation. In a case where a large amount of water has been condensed in the cryopump 10, a large amount of water vapor may vaporize due to sublimation, and the internal pressure of the cryopump 10 may exceed the triple point pressure of water. In such a case, the regeneration controller 100 may maintain the temperature of the cryopump 10 at a temperature lower than the triple point temperature of water, instead of heating the cryopump 10 to a temperature higher than room temperature.

The present invention has been described by using specific words and phrases based on the embodiments. However, the embodiments merely show one aspect of the principle and application of the present invention, and the embodiments include many modification examples or changes in disposition within a scope which does not depart from the idea of the present invention defined in the claims.

The present invention can be used in the fields of cryopumps, cryopump systems, and cryopump regeneration methods.

It should be understood that the invention is not limited to the above-described embodiment, but may be modified into various forms on the basis of the spirit of the invention. Additionally, the modifications are included in the scope of the invention.

What is claimed is:

1. A cryopump comprising:

a cryopanel;

an adsorption area provided on the cryopanel and capable of adsorbing a non-condensable gas, the adsorption area including a non-combustible adsorbent containing silica gel as a main component thereof;

a cryopump housing in which the cryopanel having the adsorption area is disposed in an interior thereof;

a pressure sensor that generates a pressure measurement signal indicating an internal pressure of the cryopump housing;

a rough valve mounted to the cryopump housing and connecting the cryopump housing to a rough pump;

a memory that stores a first threshold value of pressure rise rate being a positive value and a second threshold value of pressure rise rate being a negative value; being smaller than the first threshold value; and a regeneration controller configured to:

open the rough valve for a certain opening period in regeneration of the cryopump, wherein the rough valve remains continuously open throughout the certain opening period, receive a first pressure measurement signal from the pressure sensor measured during the certain opening period of the rough valve, compare a first pressure rise rate of the cryopump housing with the first threshold value based on the first pressure measurement signal, receive a second pressure measurement signal from the pressure sensor after it is determined that the first pressure rise rate is larger than the first threshold value based on the comparison, wherein the second pressure measurement signal is measured during the certain opening period of the rough valve, compare a second pressure rise rate of the cryopump housing with the second threshold value based on the second pressure measurement signal, and close the rough valve when the second pressure rise rate is smaller than the second threshold value.

2. The cryopump according to claim 1, wherein the silica gel has an average pore size in a range of 0.5 nm to 3.0 nm.

3. The cryopump according to claim 1, wherein the silica gel has an average pore size in a range of 2.0 nm to 3.0 nm.

4. The cryopump according to claim 1, wherein the adsorption area does not contain activated carbon.

5. The cryopump according to claim 1, wherein the regeneration controller comprises:

a first pressure rise rate monitor that receives the first pressure measurement signal measured during the certain opening period of the rough valve and compares the first pressure rise rate with the first threshold value based on the first pressure measurement signal;

a second pressure rise rate monitor that receives the second pressure measurement signal measured during the certain opening period of the rough value and compares the second pressure rise rate with the second threshold value based on the second pressure measurement signal, on a condition that the first pressure rise rate monitor determines that the first pressure rise rate is larger than the first threshold value; and a rough valve driver that closes the rough valve, on a condition that the second pressure rise rate monitor determines that the second pressure rise rate is smaller than the second threshold value, as one condition.

6. The cryopump according to claim 5, further comprising:

a condensation cryopanel that is disposed in the cryopump housing and cooled to a higher temperature than the cryopanel having the adsorption area;

a temperature sensor that generates a temperature measurement signal indicating a measured temperature of either the condensation cryopanel or the cryopanel having the adsorption area;

a purge valve mounted to the cryopump housing and connecting the cryopump housing to a purge gas source;

a temperature monitor that receives the temperature measurement signal and compares the measured temperature with a purge stop temperature; and a purge valve driver that opens the purge valve when the regeneration of the cryopump is started, and closes the purge valve on a condition that the temperature monitor determines that the measured temperature is higher than the purge stop temperature, wherein the rough valve driver opens the rough valve on a condition that the temperature monitor determines that the measured temperature is higher than the purge stop temperature, and the purge stop temperature is set to a temperature value lower than a triple point temperature of water.

7. The cryopump according to claim 5, wherein the rough valve driver closes the rough valve on an additional condition that the internal pressure of the cryopump housing is lower than a pressure threshold value.

8. The cryopump according to claim 5, wherein the rough valve driver closes the rough valve on an additional condition that a temperature in the cryopump housing is higher than a temperature threshold value.

9. The cryopump according to claim 1, wherein the regeneration controller increases a temperature of the adsorption area to 65° C. or higher during regeneration.

10. The cryopump according to claim 1, further comprising:

a compressor, wherein the cryopump operates to vaporize and discharge ice condensed in the cryopump by sublimation during abnormal stop of the compressor.

11. A cryopump system comprising:

the cryopump according to claim 1; and at least one other cryopump;

wherein the rough pump is common to the cryopump and the at least one other cryopump;

wherein the regeneration controller receives a regeneration start command for each of the cryopumps and starts the regeneration of the cryopump, and wherein the regeneration controller delays the regeneration start of the at least one other cryopump until after the regeneration of the cryopump is completed, in a case where the regeneration controller receives the regeneration start command for the at least one other cryopump, during the regeneration of the cryopump.

12. The cryopump according to claim 1, further comprising:

a condensation cryopanel that is disposed in the cryopump housing and cooled to a higher temperature than the cryopanel having the adsorption area;

a temperature sensor that generates a temperature measurement signal indicating a measured temperature of either the condensation cryopanel or the cryopanel having the adsorption area;

a purge valve mounted to the cryopump housing and connecting the cryopump housing to a purge gas source;

wherein the memory further stores a purge stop temperature being lower than a triple point temperature of water, wherein the regeneration controller is further configured to:

prior to the opening of the rough valve for the certain opening period, open the purge valve, receive the temperature measurement signal from the temperature sensor, and compare the measured temperature with the purge stop temperature based on the temperature measurement signal, and close the purge valve and start the opening of the rough valve for the certain opening period when the measured temperature is higher than the purge stop temperature.

13. The cryopump according to claim 12, wherein the purge stop temperature is selected from a range of 230 K to 270 K.

14. The cryopump according to claim 6, wherein the purge stop temperature is selected from a range of 230 K to 270 K.

* * * * *